US011325768B2

(12) United States Patent
Clare et al.

(10) Patent No.: US 11,325,768 B2
(45) Date of Patent: May 10, 2022

(54) FLEXIBLE PACKAGE AND METHOD OF MANUFACTURE

(71) Applicant: The Procter & Gamble Company, Cincinnati, OH (US)

(72) Inventors: Benjamin Jacob Clare, Cincinnati, OH (US); Joseph Craig Lester, Liberty Township, OH (US); Susana E Borrero, Mason, OH (US); Kenneth Stephen McGuire, Montgomery, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 58 days.

(21) Appl. No.: 16/516,175

(22) Filed: Jul. 18, 2019

(65) Prior Publication Data

US 2020/0024058 A1 Jan. 23, 2020

Related U.S. Application Data

(60) Provisional application No. 62/701,273, filed on Jul. 20, 2018, provisional application No. 62/783,535,
(Continued)

(51) Int. Cl.
*B65D 81/02* (2006.01)
*B65D 75/58* (2006.01)
(Continued)

(52) U.S. Cl.
CPC ..... *B65D 81/022* (2013.01); *B65B 5/02* (2013.01); *B65B 31/04* (2013.01); *B65B 43/08* (2013.01);
(Continued)

(58) Field of Classification Search
CPC ..... B65D 81/022; B65D 75/06; B65D 75/04; B65D 81/052; B65D 75/58; A45C 7/0081
(Continued)

(56) References Cited

U.S. PATENT DOCUMENTS 2,213,758 A 9/1940 Eichberg
3,030,640 A 4/1962 Gosman
(Continued)

FOREIGN PATENT DOCUMENTS

CN 202863950 U 4/2013
CN 104245058 A 12/2014
(Continued)

OTHER PUBLICATIONS

Campbell, Phillip John, "The Rigidified Standing Pouch—A Concept for Flexible Packaging", A Thesis Written in Partial Fulfillment of the Requirements for the Degree of Master of Industrial Design, North Carolina State University School of Design Raleigh, 1993, pp. 1-35.

(Continued)

*Primary Examiner* — Rafael A Ortiz
(74) *Attorney, Agent, or Firm* — James E Oehlenschlager; David M Weirich

(57) ABSTRACT

A package having a flexible inner sheet having a first surface and a second surface. The package has an article reservoir for accepting an article to be shipped. The expansion chambers can be inflated or otherwise expanded to provide structure to the package and to protect the article in the article reservoir. The package also includes an external wrap surrounding at least a portion of the package to provide a relatively planar outwardly-facing surface.

18 Claims, 24 Drawing Sheets

Related U.S. Application Data filed on Dec. 21, 2018, provisional application No. 62/810,987, filed on Feb. 27, 2019, provisional application No. 62/838,955, filed on Apr. 26, 2019, provisional application No. 62/851,230, filed on May 22, 2019, provisional application No. 62/851,224, filed on May 22, 2019, provisional application No. 62/864,555, filed on Jun. 21, 2019, provisional application No. 62/864,549, filed on Jun. 21, 2019.

(51) Int. Cl.

| | |
|---|---|
| ***B65D 81/05*** | (2006.01) |
| ***B65D 75/04*** | (2006.01) |
| ***B65D 75/56*** | (2006.01) |
| ***B65B 55/20*** | (2006.01) |
| ***B65B 43/08*** | (2006.01) |
| ***B65B 5/02*** | (2006.01) |
| ***B65B 31/04*** | (2006.01) |
| ***B65D 77/04*** | (2006.01) |
| *B65B 9/04* | (2006.01) |

(52) U.S. Cl.

CPC ..... *B65B 55/20* (2013.01); *B65D 75/04* (2013.01); *B65D 75/56* (2013.01); *B65D 75/58* (2013.01); *B65D 77/0406* (2013.01); *B65D 81/052* (2013.01); *B65B 2009/047* (2013.01); *B65D 2203/02* (2013.01)

(58) Field of Classification Search

USPC ..... 206/522, 459.5, 433; 383/3

See application file for complete search history.

(56) References Cited

U.S. PATENT DOCUMENTS 3,346,101 A 10/1967 Pestka
3,349,990 A 10/1967 Woodford
3,777,632 A 12/1973 Pepmeier
3,975,885 A 8/1976 Carlisle
4,046,314 A * 9/1977 Hill ..... B65D 5/46048 229/117.19
4,190,158 A 2/1980 Ambrose
4,267,684 A 5/1981 Ambrose
4,491,225 A 1/1985 Baillod
4,651,360 A 3/1987 Wang
4,756,032 A 7/1988 Wang
4,872,558 A 10/1989 Pharo
4,969,312 A 11/1990 Pivert
5,140,801 A 8/1992 Wild
5,170,609 A 12/1992 Bullock et al.
5,217,131 A 6/1993 Andrews
5,272,856 A * 12/1993 Pharo ..... B65D 81/052 53/472
5,307,529 A 5/1994 Wang
5,535,888 A 7/1996 De
5,639,523 A 6/1997 Ellis
6,139,188 A 10/2000 Marzano
6,520,332 B1 2/2003 Barmore
6,520,333 B1 2/2003 Tschantz
6,520,491 B2 2/2003 Timlick
6,629,777 B2 10/2003 Tanaka et al.
7,165,677 B2 1/2007 Tanaka et al.
7,303,076 B2 12/2007 Scalise
7,383,953 B2 * 6/2008 Dickinson ..... G09F 23/00 206/522
7,913,848 B2 3/2011 Liao et al.
8,157,096 B2 4/2012 Liao
8,540,094 B2 9/2013 Riedl
8,568,029 B2 10/2013 Kannankeril et al.
8,707,660 B2 4/2014 Howes
8,770,408 B2 7/2014 Tschantz
9,327,867 B2 5/2016 Stanley et al.
9,469,088 B2 10/2016 Stanley
9,623,622 B2 4/2017 Baines
9,694,942 B2 7/2017 Stanley
9,815,258 B2 11/2017 Stanley
10,040,581 B2 8/2018 Stanley
11,124,346 B2 9/2021 Borrero et al.
2002/0064319 A1 5/2002 Tanaka et al.
2003/0024846 A1 2/2003 Nadler
2003/0034270 A1 2/2003 Ribeiro
2003/0128898 A1 7/2003 Malone et al.
2003/0167572 A1 9/2003 Mileti
2004/0101658 A1 5/2004 Kannankeril
2004/0149618 A1 8/2004 Otaki
2005/0077200 A1 4/2005 Tippey
2005/0103676 A1 5/2005 Lee
2005/0109656 A1 5/2005 Ishizaki
2005/0126941 A1 6/2005 Ferri
2006/0030471 A1 2/2006 Schaller
2007/0092164 A1 4/2007 Yasuhira
2008/0029423 A1 2/2008 Davlin
2008/0035519 A1 2/2008 Swartz et al.
2008/0083640 A1 * 4/2008 Liu ..... A45C 13/021 206/522
2009/0242450 A1 10/2009 Zhang
2010/0072103 A1 3/2010 Watanabe
2010/0308062 A1 12/2010 Helou, Jr.
2011/0068154 A1 3/2011 Kannankeril et al.
2011/0192121 A1 8/2011 Kannankeril
2011/0247725 A1 10/2011 Frayne
2012/0097634 A1 4/2012 Riedl
2013/0048529 A1 * 2/2013 Liao ..... B65D 81/052 206/522
2013/0292287 A1 11/2013 Stanley et al.
2013/0292353 A1 11/2013 Stanley et al.
2013/0292395 A1 11/2013 Stanley et al.
2013/0292413 A1 11/2013 Stanley et al.
2013/0292415 A1 11/2013 Stanley et al.
2013/0294711 A1 11/2013 Stanley et al.
2013/0313152 A1 11/2013 Liao
2013/0337244 A1 12/2013 Stanley et al.
2014/0033654 A1 2/2014 Stanley et al.
2014/0033655 A1 2/2014 Stanley et al.
2014/0224700 A1 8/2014 Scarbrough et al.
2015/0033671 A1 2/2015 Stanley
2015/0034670 A1 2/2015 Stanley et al.
2015/0036950 A1 2/2015 Stanley et al.
2015/0121810 A1 5/2015 Bourgeois et al.
2015/0122373 A1 5/2015 Bourgeois et al.
2015/0122840 A1 5/2015 Cox et al.
2015/0122841 A1 5/2015 McGuire et al.
2015/0122842 A1 5/2015 Berg, Jr. et al.
2015/0122846 A1 5/2015 Stanley et al.
2015/0125099 A1 5/2015 Ishihara et al.
2015/0125574 A1 5/2015 Arent et al.
2015/0126349 A1 5/2015 Ishihara et al.
2015/0259120 A1 9/2015 Liao
2015/0287343 A1 * 10/2015 Moore ..... B65D 5/4212 340/4.14
2015/0314940 A1 11/2015 Matta
2016/0058218 A1 3/2016 Yoshifusa
2016/0088981 A1 3/2016 Cameron et al.
2016/0176578 A1 6/2016 Stanley et al.
2016/0176582 A1 6/2016 McGuire et al.
2016/0176583 A1 6/2016 Ishihara et al.
2016/0176584 A1 6/2016 Ishihara et al.
2016/0176597 A1 6/2016 Ishihara et al.
2016/0221727 A1 8/2016 Stanley et al.
2016/0297569 A1 10/2016 Berg, Jr. et al.
2016/0297589 A1 10/2016 You et al.
2016/0297590 A1 10/2016 You et al.
2016/0297591 A1 10/2016 You et al.
2016/0325518 A1 11/2016 Ishihara et al.
2016/0362228 A1 12/2016 McGuire et al.
2017/0001782 A1 1/2017 Arent et al.
2017/0233116 A1 8/2017 Stanley et al.
2017/0247164 A1 8/2017 Zhang
2017/0305609 A1 10/2017 McGuire et al.
2017/0305627 A1 10/2017 Arent et al.
2017/0314283 A1 11/2017 Liu
2018/0079574 A1 3/2018 Ishihara et al.

(56) References Cited

U.S. PATENT DOCUMENTS

| | | | |
|---|---|---|---|
| 2018/0236741 | A1 | 8/2018 | Hargett et al. |
| 2018/0237172 | A1 | 8/2018 | Lester et al. |
| 2018/0257836 | A1 | 9/2018 | McGuire et al. |
| 2018/0297725 | A1 | 10/2018 | Bourgeois et al. |
| 2018/0312283 | A1 | 11/2018 | Bourgeois et al. |
| 2018/0312286 | A1 | 11/2018 | Lester et al. |
| 2018/0370709 | A1 | 12/2018 | Kim |
| 2019/0352033 | A1 | 11/2019 | Lester |
| 2020/0024049 | A1 | 1/2020 | Borrero |
| 2020/0024050 | A1 | 1/2020 | Borrero |
| 2020/0024051 | A1 | 1/2020 | Lester |
| 2020/0024053 | A1 | 1/2020 | Borrero |
| 2020/0024054 | A1 | 1/2020 | Borrero |
| 2020/0024055 | A1 | 1/2020 | Borrero |
| 2020/0024056 | A1 | 1/2020 | Borrero |
| 2020/0024057 | A1 | 1/2020 | Borrero |
| 2021/0284420 | A1 | 9/2021 | Borrero et al. |

FOREIGN PATENT DOCUMENTS

| | | | |
|---|---|---|---|
| CN | 104284778 | A | 1/2015 |
| CN | 107107477 | A | 8/2017 |
| EP | 2631195 | A1 | 8/2013 |
| EP | 2801537 | A1 | 11/2014 |
| EP | 3575239 | A1 | 12/2019 |
| FR | 2680764 | B1 | 3/1994 |
| GB | 1403912 | A | 8/1975 |
| GB | 2213464 | A | 8/1989 |
| WO | 9601775 | A1 | 1/1996 |
| WO | WO9737905 | A1 | 10/1997 |
| WO | 2004103851 | A1 | 12/2004 |
| WO | WO2012073004 | | 6/2012 |
| WO | 2014199368 | A1 | 12/2014 |
| WO | 2015012558 | A1 | 1/2015 |
| WO | 2016078579 | A1 | 5/2016 |
| WO | 2017150857 | A2 | 9/2017 |

OTHER PUBLICATIONS

All Office Actions, U.S. Appl. No. 16/515,317.
All Office Actions, U.S. Appl. No. 16/515,507.
All Office Actions, U.S. Appl. No. 16/515,537.
International Search Report and Written Opinion; Application No. US2019/042480; dated Oct. 21, 2019; 12 pages.
All Office Actions; U.S. Appl. No. 16/515,331, filed Jul. 18, 2019.
All Office Actions; U.S. Appl. No. 16/515,365, filed Jul. 18, 2019.
All Office Actions; U.S. Appl. No. 16/615,416, filed Jul. 18, 2019.
All Office Actions; U.S. Appl. No. 16/515,887, filed Jul. 18, 2019.
All Office Actions; U.S. Appl. 16/516,173, filed Jul. 18, 2019.
All Office Actions; U.S. Appl. No. 17/190,452, filed Mar. 3, 2021.
All Office Actions; U.S. Appl. No. 17/500,252, filed Oct. 13, 2021.
All Office Actions; U.S. Appl. No. 17/506,026, filed Oct. 20, 2021.
U.S. Unpublished Appl. No. 17/500,252, filed Oct. 13, 2021, to Susana E. Borrero et al.
U.S. Unpublished Appl. No. 17/506,026, filed Oct. 20, 2021, to Joseph Craig Lester et al.

* cited by examiner

Fig 26
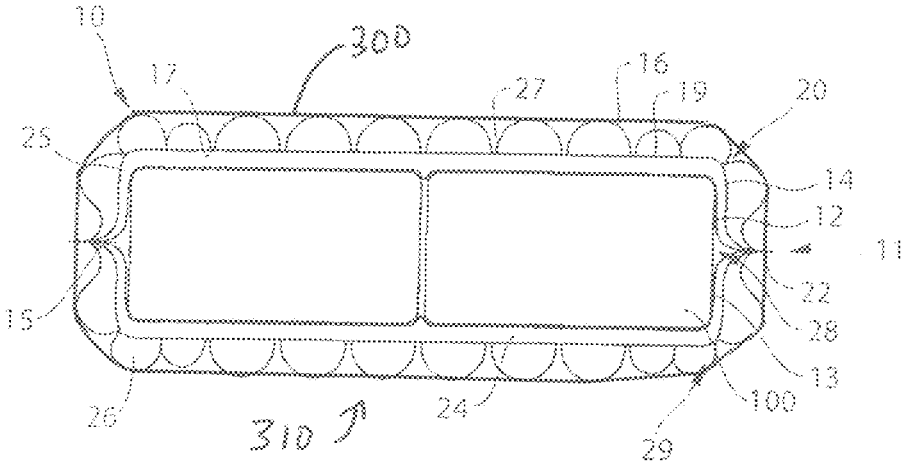
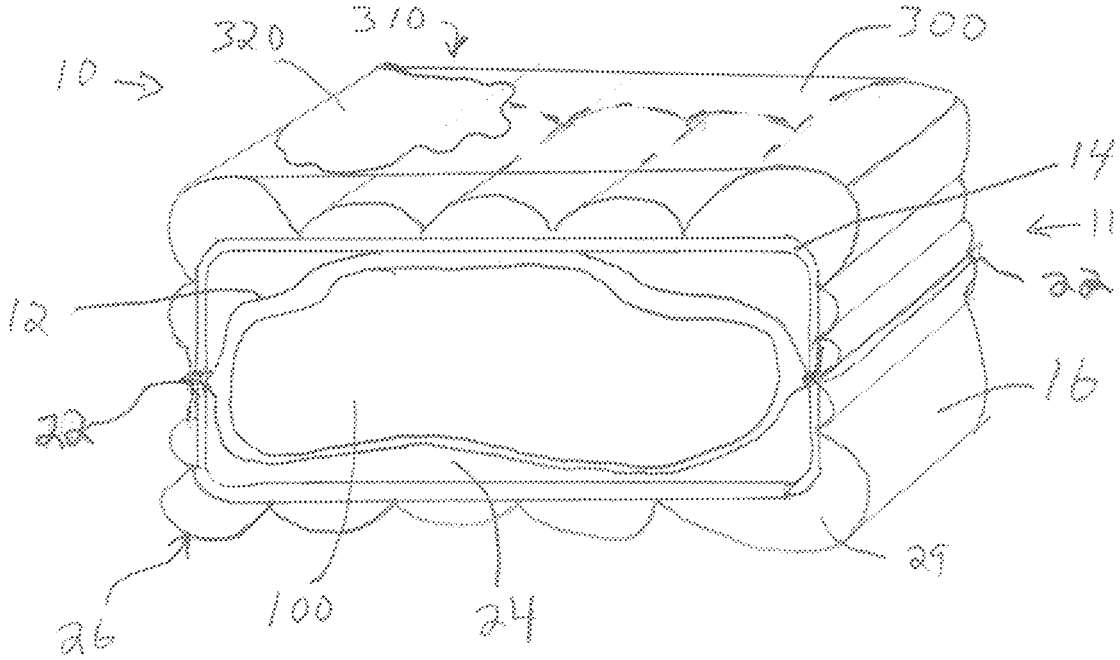
Fig. 27

FLEXIBLE PACKAGE AND METHOD OF MANUFACTURE

FIELD

The present disclosure relates in general to packages, and, in particular, to shipping packages made from one or more flexible materials.

BACKGROUND

E-commerce, or the use of the internet to find and purchase goods, is becoming a very popular way for consumers to shop. The advantages of e-commerce are many including: time-savings; competition; shopping at home, work or virtually anywhere; and importantly, the purchaser not having to transport the purchased articles from the location of purchase to the place of use. In the e-commerce system, goods purchased by consumers are generally transported to their homes or places of use by the seller or a service used by the seller. Many e-commerce retailers rely on shipping their goods through the mail, including government mail services and other private and semi-private mail services, or through other parcel or parcel-like delivery services. Such mail and parcel services are typically quite convenient to both the buyer and seller. However, transportation of fragile, heavy and/or bulky goods can be quite expensive due to the cost of the manual labor and materials needed to protect the goods during shipment.

These aspects, and others, relating to the shipment of goods through current mail and parcel delivery services create unique issues that, if not addressed, can negatively affect the cost and quality of the goods sold. For example, when shipping goods to consumers, the goods generally need to be disposed in a package that is strong, lightweight and convenient for the shipper and for the customer. That is, it should be designed to be capable of protecting the products being shipped from external conditions throughout the shipping process, and preferably so as to minimize material usage, weight and bulkiness. It should also be easy to construct, pack, close, label, open, and discard. If the shipping package does not meet any one or all of these characteristics, it can lead to extra costs, inconvenience for the seller or buyer, product damage, and/or consumer dissatisfaction.

Currently, most shipping packages are some form of flexible pouch (e.g. envelope) made from paper or plastic, or a box, often constructed from corrugated paperboard or cardboard. Although these shipping packages can be used to ship many different types of goods and are reasonably inexpensive, they generally are generic in the sense that they do not provide a custom fit for the products being shipped. This can lead to additional packaging being required to prevent damage to the products being shipped, significant volume being taken up in shipping trucks and warehouses due to the ill-fitting packaging, and difficulty for the consumer to open and/or discard of the shipping packaging. To address the ill-fitting, generic packaging, sellers often stuff the outer shipping packages with some type of material intended to fill the open area not filled by the goods themselves. Alternatively, sellers may employ additional processes to manipulate the products, and/or add protective layers to the product or primary packaging to ensure the product can be safe when placed into generic containers. However, both of these scenarios add more steps to the process, weight, waste, and cost to the packaging and packing process, and often makes the consumer's experience when opening the package less than desirable (e.g. "packing peanuts" falling out of the package, needing a tool to open the package, etc.). Further, many of the current shipping packages are not weather or environment-resistant and can be damaged by or allow damage to the products being shipped by precipitation, wet surfaces and/or humidity. Accordingly, often such packages are wrapped in additional materials or must be placed in protected locations if they are to be left outside or unattended for any period of time. Further, if packages are used that include inflated or expanded regions, such packages may be shaped such that they are not easily labeled or printed on or such that any indicia or graphics are distorted and/or difficult to read by a human or machine. This can cause difficulties during shipment, warehousing, and inventory and can be less desirable for a consumer.

Thus, it would be desirable to provide a package that is low cost, yet flexible in terms of fit to the products being shipped. It also would be desirable to provide a package that requires no additional fill to protect the goods. It also would be desirable to provide a package that is easy to pack. It also would be desirable to provide a package that is lightweight, yet provides protection to the goods being shipped. It also would be desirable to provide a package that is easy to close. It also would be desirable to provide a package that is easy to discard. It also would be desirable to provide a package that takes up very little volume before and after use and is efficient in terms of volume when configured for shipping. It would also be desirable to provide a package that has one or more relatively planar externally-facing surfaces. It would be desirable to provide the one or more relatively planar externally-facing surfaces with a material that is separately manufactured and/or printable from the package. The various aspects of the invention described herein can provide solutions to these problems, including by providing a package made of flexible materials joined together to provide one or more expansion chambers and an article reservoir.

SUMMARY

In order to address one or more of the above-noted deficiencies, disclosed is a package, such as a flexible shipping package for one or more articles, comprising: a flexible inner sheet having a first surface and a second surface, an inner sheet first portion and an inner sheet second portion; a flexible outer sheet having an outer sheet first portion, and an outer sheet second portion, at least a portion of the outer sheet first portion being joined to the first surface of the inner sheet first portion to form one or more first primary expansion chambers therebetween, and at least a part of the outer sheet second portion being joined to the first surface of the inner sheet second portion to form one or more second primary expansion chambers therebetween; at least a portion of the second surface of the inner sheet first portion disposed in face-to-face relationship with and joined to a portion of the second surface of the second portion of the inner sheet forming an article reservoir therebetween; a closeable opening into which the one or more articles may be inserted; an article retrieval feature that allows a user to open the package and retrieve the one or more articles from the article reservoir; and an external wrap surrounding at least a portion of the package and providing at least one relatively planar outwardly-facing surface for the package.

Also disclosed is a method of making a package, the method including the steps of: providing a flexible inner sheet having an inner sheet first portion, an inner sheet second portion, an inner sheet first surface, an inner sheet second surface; providing a flexible outer sheet in face-to-face relationship with the inner sheet, the outer sheet having an outer sheet first portion, an outer sheet second portion, an outer sheet inner surface and an outer sheet outer surface; joining at least a portion of the outer sheet first portion to the first surface of the inner sheet first portion to form one or more first primary expansion chambers therebetween; joining at least a part of the outer sheet second portion to the first surface of the inner sheet second portion to form one or more second primary expansion chamber therebetween; providing a secondary outer sheet material disposed adjacent the outer surface of at least a portion of the outer sheet and is joined thereto to form one or more secondary expansion chambers; joining at least a portion of the second surface of the inner sheet first portion with a portion of the second surface of the second portion of the inner sheet forming an article reservoir therebetween; providing a closeable opening into which the one or more articles may be inserted, the opening extending from an exterior of the package to the article reservoir; providing an article retrieval to allow a user to open the package and retrieve the one or more articles from the article reservoir; and providing an external wrap adjacent at least a portion of the secondary outer sheet.

These and additional features will be more fully disclosed in the following detailed description in conjunction with the drawings.

BRIEF DESCRIPTION OF THE DRAWINGS

Several figures are provided to help the reader understand the invention. The figures are intended to be viewed in conjunction with the specification and are not intended to be limiting beyond that of the wording of the specification. Reference numbers are used to identify different features of the figures. The same reference numbers are used throughout the specification and drawings to show the same features, regardless of the variation of the invention that is depicted.

FIG. 26 is a cross-sectional view of a package having an outer wrap disposed about the package.

FIG. 27 is an isometric, cross-sectional view of a package of the present invention having an outer wrap disposed about a portion of the package.

DETAILED DESCRIPTION

Figure 1:
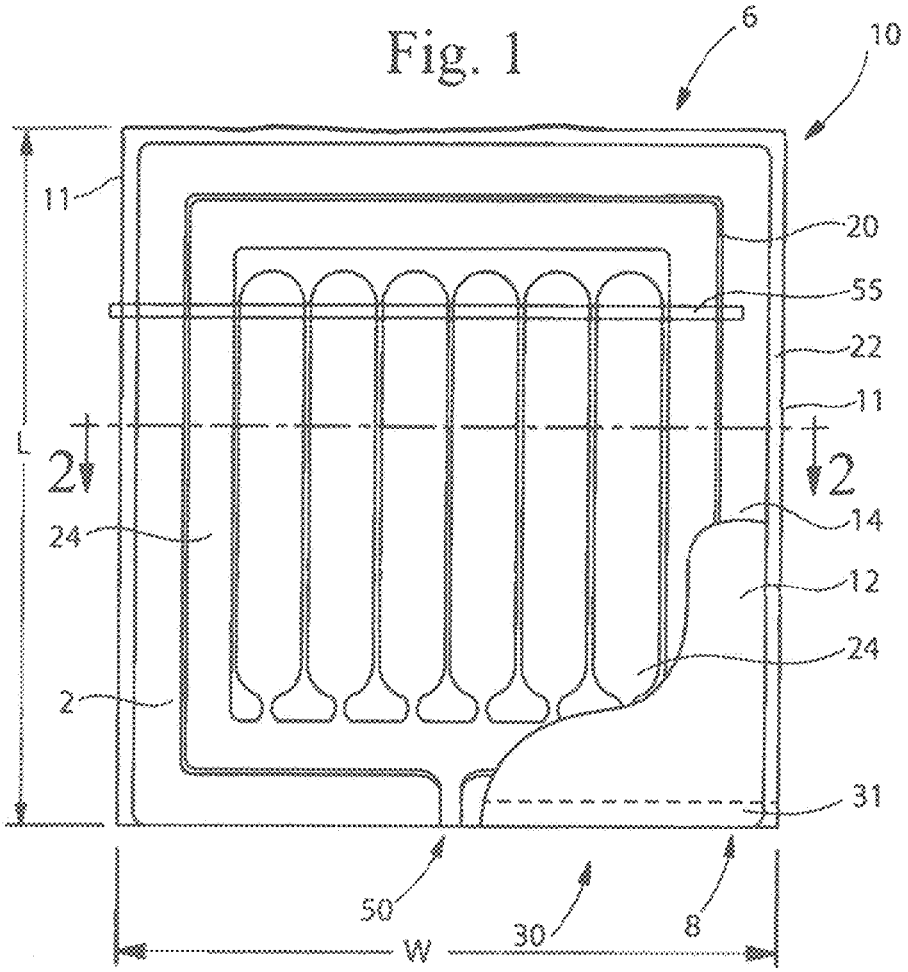
FIG. 1 illustrates a plan view of a flexible package of the type disclosed herein in an unexpanded state.

The present disclosure describes packages, such as primary packages, secondary packages, shipping packages, display packages and/or other packages made from one or more flexible materials. Although the invention is described and illustrated herein as a shipping package, the disclosure is not intended to limit the scope of the invention to a particular use and the disclosure should be considered applicable to all different types of packages having the disclosed features. Because these packages are made from flexible material(s), they can be less expensive to make, can use less material, can provide better protection, and can be easier to decorate, when compared with conventional rigid packages. These packages can be less expensive to make because the conversion of flexible materials (from sheet form to finished goods) generally requires less energy and complexity than formation of rigid materials (from bulk form to finished goods). They may use less material, because they are configured with novel support structures that do not require the use of the thick solid walls used in conventional rigid packages. They also can be easier to decorate because their flexible materials can be easily printed before or after they are constructed into three-dimensional shipping packages. Such flexible packages can be less prone to scuffing, denting, and rupture, because flexible materials allow their outer surfaces to deform when contacting surfaces and objects, and then to return to their original shape. They can provide better protection by making the packages out of weather and environment-resistant materials and configuring the materials in such a way (e.g. expansion of portions thereof) to provide protection from dropping and other physical forces during shipping and handling. Importantly, even though the shipping packages of the present disclosure are made from flexible material(s), they can be configured with sufficient structural integrity, such that they can receive and contain one or more articles or products, as intended, without failure. Also, these packages can be configured with sufficient structural integrity, such that they can withstand external forces and environmental conditions from shipping and handling, without failure.

Yet another desirable feature of the packages of the present invention is that they can be easily shaped and configured for machine handling and use with autonomous vehicles and drones. The packages provide protection from bumping and dropping and have expandable chambers that can be used to provide grip regions for humans and machines.

As used herein, the term "ambient conditions" refers to a temperature within the range of 15-35 degrees Celsius and a relative humidity within the range of 35-75%.

As used herein, the term "closed" refers to a state of a package, wherein any products within the package are prevented from escaping the package (e.g. by one or more materials that form a barrier), but the package is not necessarily hermetically sealed. For example, a closed package can include a vent, which allows a head space in the package to be in fluid communication with air in the environment outside of the package.

As used herein, when referring to a flexible package, the terms "disposable" and "single use" refer to packages which, after being used for its intended purpose (e.g. shipping a product to an end user), are not configured to be reused for the same purpose, but is configured to be disposed of (i.e. as waste, compost, and/or recyclable material). Part, parts, or all of any of the flexible packages, disclosed herein, can be configured to be disposable and/or recyclable.

As used herein, when referring to a flexible package, the term "expanded" or "inflated" refers to the state of one or more flexible materials that are configured to change shape when an expansion material is disposed therebetween. An expanded structure has one or more dimensions (e.g. length, width, height, thickness) that is significantly greater than the combined thickness of its one or more flexible materials, before the structure has one or more expansion materials disposed therein. Examples of expansion materials include liquids (e.g. water), gases (e.g. compressed air), fluent products, foams (that can expand after being added into a structural support volume), co-reactive materials (that produce gas or foam), or phase change materials (that can be added in solid or liquid form, but which turn into a gas; for example, liquid nitrogen or dry ice), or other suitable materials known in the art, or combinations of any of these (e.g. fluent product and liquid nitrogen). Expansion materials can be added at atmospheric pressure, or added under pressure greater than atmospheric pressure, or added to provide a material change that will increase pressure to something above atmospheric pressure. For any of the flexible packages disclosed herein, its one or more flexible materials can be expanded at various points in time with respect to its manufacture, sale, and use. For example, one or more portions of the package may be expanded before or after the product to be shipped in the package is inserted into the package, and/or before or after the flexible package is purchased by an end user.

As used herein, the term "flexible shipping package" refers to a flexible package configured to have an article reservoir for containing one or more articles for shipment. Examples of flexible packages can be made from film, woven web, non-woven web, paper, foil or combinations of these and other flexible materials.

As used herein, when referring to a flexible package, the term "flexible material" refers to a thin, easily deformable, sheet-like material, having a flexibility factor within the range of 1,000-2,500,000 N/m. Flexible materials can be configured to have a flexibility factor of 1,000-2,500,000 N/m, or any integer value for flexibility factor from 1,000-2,500,000 N/m, or within any range formed by any of these values, such as 1,000-1,500,000 N/m, 1,500-1,000,000 N/m, 2,500-800,000 N/m, 5,000-700,000 N/m, 10,000-600,000 N/m, 15,000-500,000 N/m, 20,000-400,000 N/m, 25,000-300,000 N/m, 30,000-200,000 N/m, 35,000-100,000 N/m, 40,000-90,000 N/m, or 45,000-85,000 N/m, etc. Throughout the present disclosure the terms "flexible material", "flexible sheet", "sheet", and "sheet-like material" are used interchangeably and are intended to have the same meaning. Examples of materials that can be flexible materials include one or more of any of the following: films (such as plastic films), elastomers, foamed sheets, foils, fabrics (including wovens and nonwovens), biosourced materials, and papers, in any configuration, as separate material(s), or as layer(s) of a laminate, or as part(s) of a composite material, in a microlayered or nanolayered structure, and in any combination, as described herein or as known in the art. For example, a flexible material may be a laminate of a paper to a PVOH material. Part, parts, or all of a flexible material can be coated or uncoated, treated or untreated, processed or unprocessed, in any manner known in the art. Parts, parts, or about all, or approximately all, or substantially all, or nearly all, or all of a flexible material can made of sustainable, bio-sourced, recycled, recyclable, and/or biodegradable material. Part, parts, or about all, or approximately all, or substantially all, or nearly all, or all of any of the flexible materials described herein can be partially or completely translucent, partially or completely transparent, or partially or completely opaque. The flexible materials used to make the packages disclosed herein can be formed in any manner known in the art, and can be joined together using any kind of joining or sealing method known in the art, including, for example, heat sealing (e.g. conductive sealing, impulse sealing, ultrasonic sealing, etc.), welding, crimping, bonding, adhering, and the like, and combinations of any of these.

As used herein, the term "joined" refers to a configuration wherein elements are either directly connected or indirectly connected.

As used herein, the term "shrinkable material" refers to a material that can reduced in size or contracted (e.g. shrunk) when exposed to a predetermined external stimulus. Examples of shrinkable materials include films made of or including PVC or Polyolefin. Other examples are polymer materials that have been subject to strain prior to implementation in the package such as PET, PLA, polyhydroxyalkanoate and copolymers. Typical stimuli for activating shrinkable materials include light, radiation (including electromagnetic radiation and particle radiation), heat, hot air, water vapor, and humidity, but other stimuli and combinations thereof are contemplated.

As used herein, when referring to a sheet or sheets of flexible material, the term "thickness" refers to a linear dimension measured perpendicular to the outer major surfaces of the sheet, when the sheet is lying flat. The thickness of a package is measured perpendicular to a surface on which the package is placed such that the sheet would be lying flat if the package were not in an expanded state. To compare the thickness of a package in an unexpanded state, an expanded state and a deflated state, the thickness of each should be measured in the same orientation on the same surface. For any of the configurations, the thickness is considered to be the greatest thickness measurement made across the surface or face of the article in that particular orientation.

As used herein, the term "article reservoir" refers to an enclosable three-dimensional space that is configured to receive and contain one or more articles or products. This three-dimensional space may enclose a volume, the "article reservoir volume". The articles or products may be directly contained by the materials that form the article reservoir. By directly containing the one or more products, the products come into contact with the materials that form the enclosable three-dimensional space, there is no need for an intermediate material or package. Throughout the present disclosure the terms "reservoir" and "article reservoir" are used interchangeably and are intended to have the same meaning. The shipping packages described herein can be configured to have any number of reservoirs. Further, one or more of the reservoirs may be enclosed within another reservoir. Any of the reservoirs disclosed herein can have a reservoir volume of any size. The reservoir(s) can have any shape in any orientation.

As used herein, when referring to a flexible package, the term "expansion chamber" refers to a fillable space made from one or more flexible materials, wherein the space is configured to be at least partially filled with one or more expansion materials, which create tension in the one or more flexible materials, and form an expanded volume.

As used herein, when referring to a flexible package, the term "unexpanded" refers to the state of an expansion chamber, when the chamber does not include an expansion material.

Flexible shipping packages, as described herein, may be used across a variety of industries for a variety of products. For example, flexible packages, as described herein, may be used for shipping across the consumer products industry, including but not limited to the following products: cleaning products, disinfectants, dishwashing compositions, laundry detergents, fabric conditioners, fabric dyes, surface protectants, cosmetics, skin care products, hair treatment products, soaps, body scrubs, exfoliants, astringents, scrubbing lotions, depilatories, antiperspirant compositions, deodorants, shaving products, pre-shaving products, after shaving products, toothpaste, mouthwash, personal care products, baby care products, feminine care products, insect repellants, foods, beverages, electronics, medical devices and goods, pharmaceuticals, supplements, toys, office supplies, household goods, automotive goods, aviation goods, farming goods, clothing, shoes, jewelry, industrial products, and any other items that may be desirable to ship through the mail or other parcel services, etc.

The flexible packages disclosed herein can be configured to have an overall shape. In the unexpanded state, the overall shape may correspond to any known two-dimensional shape including polygons (shapes generally comprised of straight-portions connected by angles), curved-shapes (including circles, ovals, and irregular curved-shapes) and combinations thereof. In the expanded state, the overall shape may correspond with any other known three-dimensional shape, including any kind of polyhedron, any kind of prismatoid, and any kind of prism (including right prisms and uniform prisms).

FIG. 1 illustrates a plan view of the top portion 2 of a flexible shipping package 10 of the type disclosed herein in an unexpanded state. As shown, the package 10 includes an inner sheet 12 and an outer sheet 14. The inner sheet 12 is at least partially joined to the outer sheet 14 along primary expansion chamber seams 20. The package 10, as shown, has a length L, a width W, side edges 11 and opposing ends 6 and 8.

Figure 2:
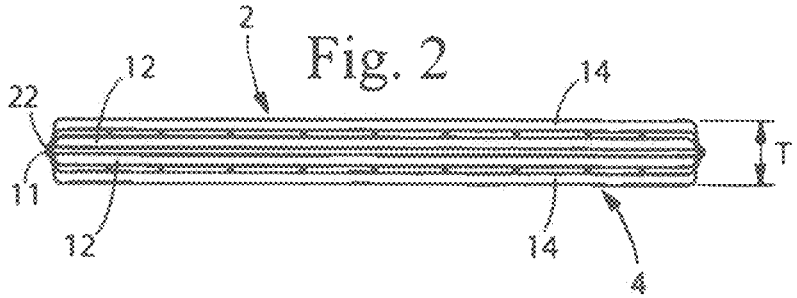
FIG. 2 illustrates a side view of the flexible package of FIG. 1.

FIG. 2 illustrates a side view of the flexible shipping package of FIG. 1. As can be seen, the package 10 may be relatively thin, flat and planar in its non-expanded state. That is, the unexpanded thickness T1 of the package 10 is relatively small when compared to the length L and width W of the package 10 in its unexpanded state or configuration, as well as the thickness T2 of the package 10 in an expanded configuration (e.g. FIG. 4). As shown in FIG. 2, the package 10 of FIG. 1 may be constructed from two separate, two-sheet pieces joined together to form a top portion 2 and a bottom portion 4 of the package 10. The top portion 2 is joined to the bottom portion 4 along at least a portion of longitudinal sides 11 of the package 10 at one or more exterior seams 22. The terms "top" and "bottom" are not intended to be limiting, but rather merely to help more clearly distinguish parts of the package from each other. As such, unless specifically set forth, the terms should not be considered to limit the orientation of the package in any way. The exterior seams 22 can take on any desired shape and size and can be formed by any suitable method or material. For example, the exterior seams 22 may be formed by glue, heat (e.g. ultrasound, conductive sealing, impulse sealing, ultrasonic sealing, or welding), mechanical crimping, sewing, or by any other known or developed technology for joining sheets of material.

Figure 3:
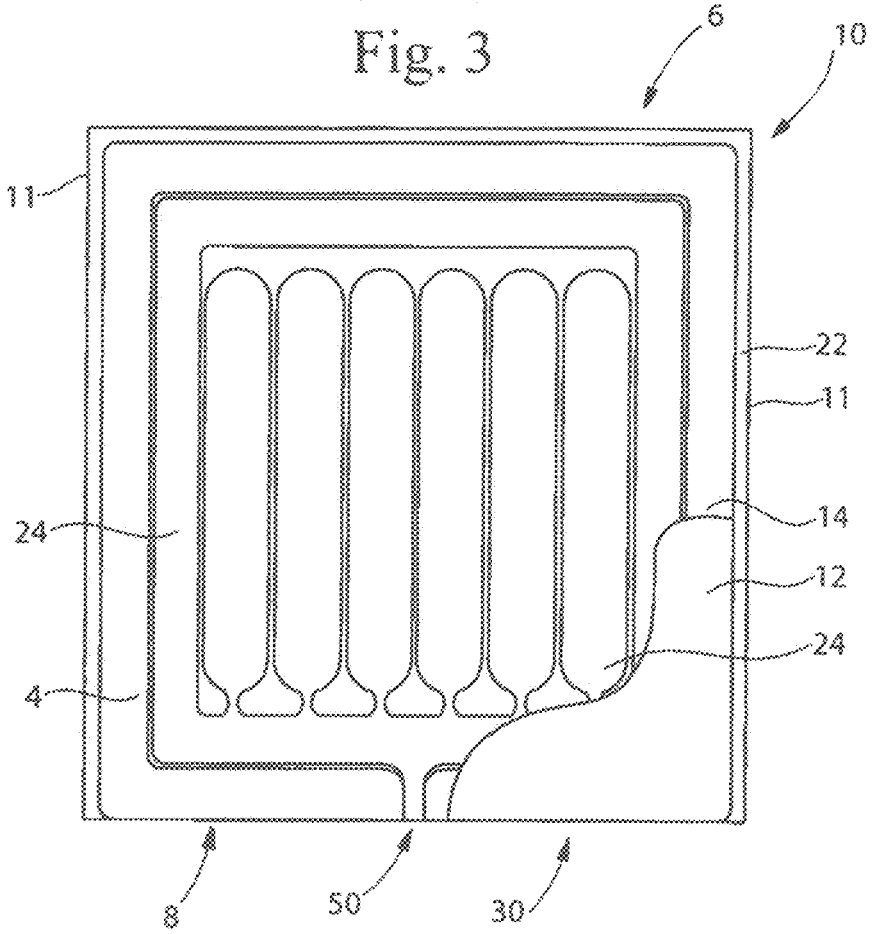
FIG. 3 illustrates a bottom view of the flexible package of FIG. 1.

FIG. 3 illustrates a plan view of the bottom portion 4 of the package 10 of FIG. 1. As shown, the bottom portion 4 has an inner sheet 12 and an outer sheet 14. Similar to that shown in FIG. 1, the inner sheet 12 is at least partly connected to the outer sheet 14 to form one or more primary expansion chambers 24 described in more detail, below. If more than one primary expansion chamber 24 is provided, the primary expansion chambers 24 may be independent from each other or in fluid communication with each other, depending on the desired characteristics of the package. When in fluid communication, the primary expansion chambers 24 can be expanded (e.g. inflated) or deflated as a single unit, whereas if they are independent from each other, they would typically be expanded or deflated separately.

Figure 4:
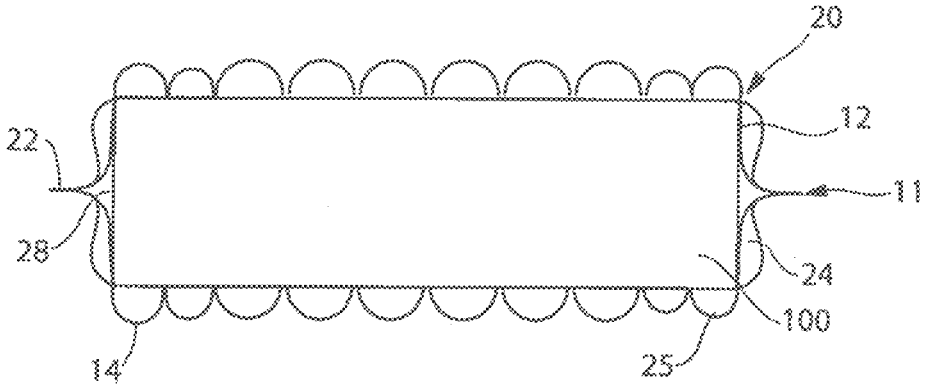
FIG. 4 is cross-sectional view of the flexible package of FIG. 1, as seen through section 2-2, having an article inside the article reservoir, wherein the package is in an expanded state.

FIG. 4 is a cross-sectional view of a flexible package 10 shown in FIG. 1 taken through section 1-1. The package 10 is shown in an expanded state and has article 100 therein. As can be seen, the inner sheet 12 is joined to the outer sheet 14 in at least the area of the exterior seam 22 to form a primary expansion chamber 24. The primary expansion chamber 24 is in an expanded configuration where an expansion material 25 has been provided into the primary expansion chamber 24. The expansion material 25 increases the spacing between the sheets forming the volume of the primary expansion chamber(s) 24 such that the expanded primary expansion chamber(s) 24 each have a volume that is greater than the primary expansion chamber(s) 24 volume when not filled with the expansion material 25. The primary expansion chamber(s) 24 may provide structural rigidity, mechanical protection and/or shape to the package 10 when in an expanded configuration. They may also help to restrain any articles 100 placed into the package 10.

The package 10 in its expanded configuration has an expanded thickness T2. The expanded thickness T2 is significantly larger than the unexpanded thickness T1. The ability for the package to change size between its unexpanded state and expanded state is one of the reasons why the package of the present invention is unique and advantageous. The package 10 can be manufactured, shipped and stored in an unexpanded state and then expanded only when needed. This allows for significant efficiencies in terms of handling and storing the packages 10 before use. The same is true of the package 10 at the end of the shipping lifecycle. Whether it is intended to be reused or discarded, the package 10 can be deflated from its expanded state to a deflated state. As used herein, the term "deflated" means any pressure from an expansion material that is causing an expansion chamber to expand has been released. A "deflated state" is when the package 10 has been expanded by introduction of an expansion material into one or more expansion chambers, but then the expansion chambers have been opened or otherwise made to be in fluid communication with the surrounding atmosphere and the expansion chambers are all in a state of equilibrium with respect to pressure of the surrounding atmosphere. Any measurements made of a package 10 in a deflated state should be made without any articles 100 in the article reservoir 28 unless otherwise set forth herein.

Figure 5:
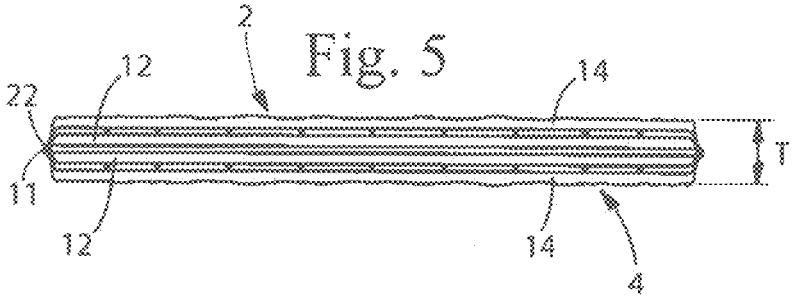
FIG. 5 is a cross-sectional view of the flexible package of FIG. 1, as seen through section 2-2, in a deflated state.

FIG. 5 shows the package of FIGS. 1-4 in its deflated state after the article(s) 100 have been removed. The package 10 has a deflated thickness T3 that can be significantly smaller than the expanded thickness T2. As such, the volume of waste to dispose of related to the package 10 is minimized and/or the package 10 can be stored for later use or shipped to another location for re-use or refurbishment. Although the specific difference between the thicknesses of the package 10 prior to use, during use, and after use will vary depending on the particular package and materials used, the package 10 of the present invention can provide an unexpanded thickness T1 that is less than $1/10^{th}$ of the expanded thickness T2, less than $1/15^{th}$ of the expanded thickness T2, less than $1/20^{th}$ of the expanded thickness T2, less than $1/25^{th}$ of the expanded thickness T2, less than $1/50^{th}$ of the expanded thickness T2 or even less. Similarly, the package 10 of the present invention can provide a deflated thickness T3 that is less than $1/10^{th}$ of the expanded thickness T2, less than $1/15^{th}$ of the expanded thickness T2, less than $1/20^{th}$ of the expanded thickness T2, less than $1/25^{th}$ of the expanded thickness T2 or even less. Further, the package 10 of the present invention can be configured such that the unexpanded thickness T1 and the deflated thickness T3 are both less than $1/15^{th}$ of the expanded thickness T2, less than $1/20^{th}$ of the expanded thickness T2, less than $1/25^{th}$ of the expanded thickness T2, or even less.

As shown in FIG. 4, an article 100 is located in the space between inner sheets 12. The space between the inner sheets 12 is referred to herein as the article reservoir 28. The article reservoir 28 can be formed between two portions of a single inner sheet 12 or can be formed between two or more different inner sheets 12, depending on the particular configuration of the package 10. The article reservoir 28 is intended to surround at least a portion of one or more articles 100 placed therein. Different shaped packages 10 can be used for different shaped articles 100, different sized articles 100, and/or different numbers of articles 100. However, one of the advantages of the package 10 of the present invention is that a single size and shape of the package can be designed and constructed to fit many different sized articles 100. This is due do the flexible nature of the materials making up the package 10 as well as the fact that portions of the package 10 can be expanded or contracted to snugly fit, for example, inner sheet 12, around the article(s) 100 and even provide for partial or complete immobilization of the article(s) in the package 100. Alternatively, or in addition, a vacuum or partial vacuum can be applied to the article reservoir 28. The vacuum can help bring the inner sheets 12 in contact with the articles 100 and to hold them snugly in place. Removing the air and/or filling the reservoir 28 with a fluid other than air, such as, for example, nitrogen, can provide additional benefits depending on the particular articles 100 being shipped. For example, filling the reservoir 28 with nitrogen can help reduce the negative effects that water vapor and oxygen can have on some items. Of course, other fluids can also be used depending on the items being shipped and the desires of the shipper.

Although the package 10 shown and described with respect to FIG. 1 has two sheets, inner sheet 12 and outer sheet 14, joined together to form the top portion 2 of the package 10, any number of sheets can be used depending on the desired end structure of the package 10. Different numbers of sheets could be used to provide additional strength, decoration, protection and/or other characteristics.

Figure 6:
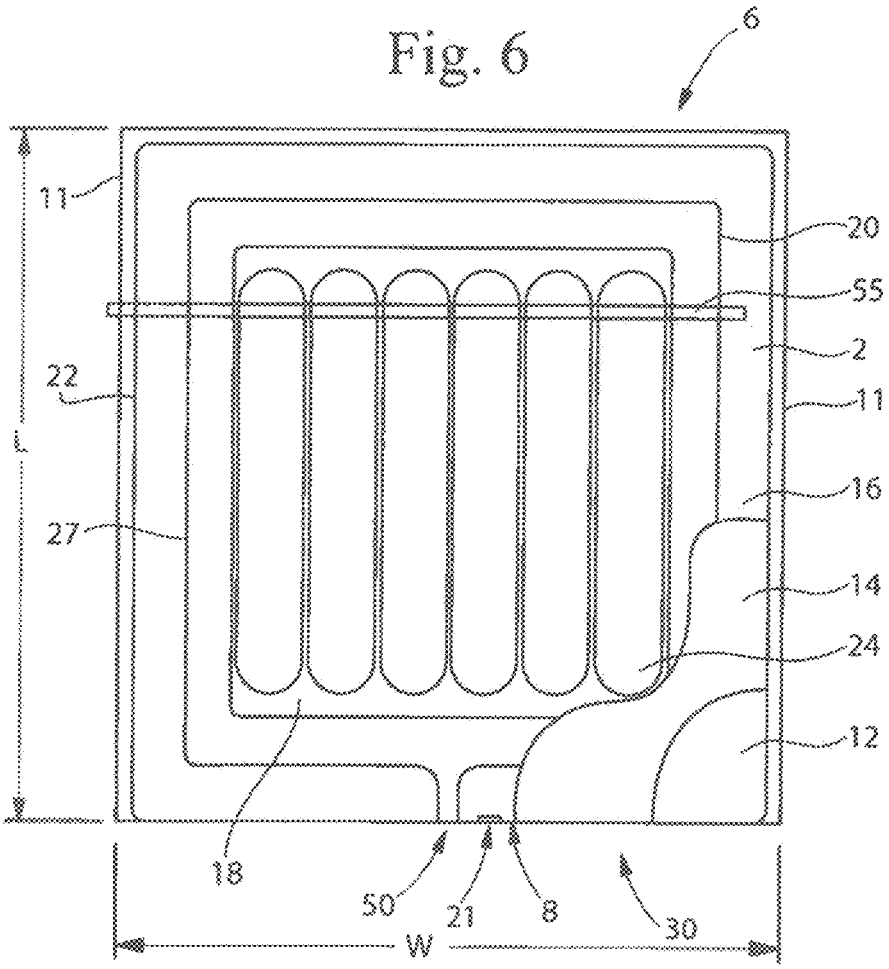
FIG. 6 illustrates a plan view of a flexible package of the type disclosed herein in an expanded state.

FIG. 6 illustrates a plan view of the top portion 2 of a flexible package 10 of the type disclosed herein in an unexpanded state. As shown, the package 10 includes an inner sheet 12, an outer sheet 14 and a secondary outer sheet 16. The inner sheet 12 is at least partly connected to the outer sheet 14 to form a primary expansion chamber 24. The outer sheet 14 is also at least partially joined to the secondary outer sheet 16 along secondary expansion chamber seams 27 to form at least one secondary expansion chamber 26. The package 10, as shown, has a length L, a width W, side edges 11 and opposing ends 6 and 8.

Figure 7:
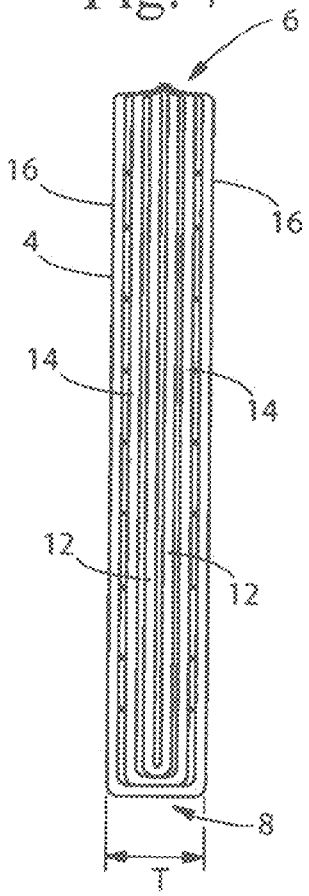
FIG. 7 illustrates a side view of the flexible package of FIG. 6.

FIG. 7 illustrates a side view of the flexible package of FIG. 6. As can be seen, the package 10 is relatively, thin, flat and planar in its non-expanded state. That is, the thickness T of the package 10 is relatively small when compared to the length L and width W of the package 10 in its unexpanded state. As shown in FIG. 7, the package 10 of FIG. 6 is constructed from three layers of material that are folded to form the top portion 2, a bottom portion 4, a first end portion 6 and a second end portion 8. The top portion 2 is joined to the bottom portion 4 along at least a portion of longitudinal sides 11 of the package. As with the description of FIGS. 1-4 the terms "top" and "bottom" are not intended to be limiting, but rather merely to help more clearly distinguish parts of the package from each other. As such, unless specifically set forth, the terms should not be considered to limit the orientation of the package in any way. The top portion 2 may be joined to the bottom portion 4 by one or more exterior seams 22. The exterior seams 22 can take on any desired shape and size and can be formed by any suitable method or material, as set forth above.

Figure 8:
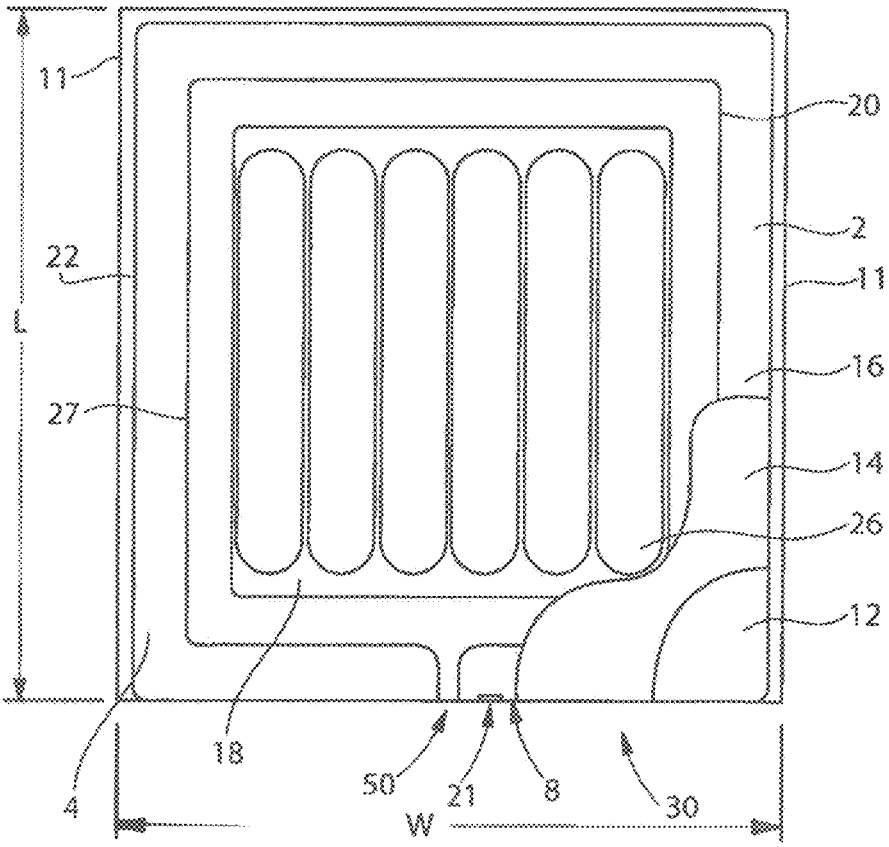
FIG. 8 illustrates a bottom view of the flexible package of FIG. 6.

FIG. 8 illustrates a plan view of the bottom portion 4 of the package 10 of FIG. 6. As shown, the bottom portion 4 the inner sheet 12, the outer sheet 14 and the secondary outer sheet 16. Similar to that shown in FIG. 6, the inner sheet 12 is at least partly connected to the outer sheet 14 to form a primary expansion chamber 24 shown in FIG. 7. The outer sheet 14 is also at least partially joined to the secondary outer sheet 16 along secondary expansion chamber seams 27 to form at least one secondary expansion chamber 26.

Figure 9:
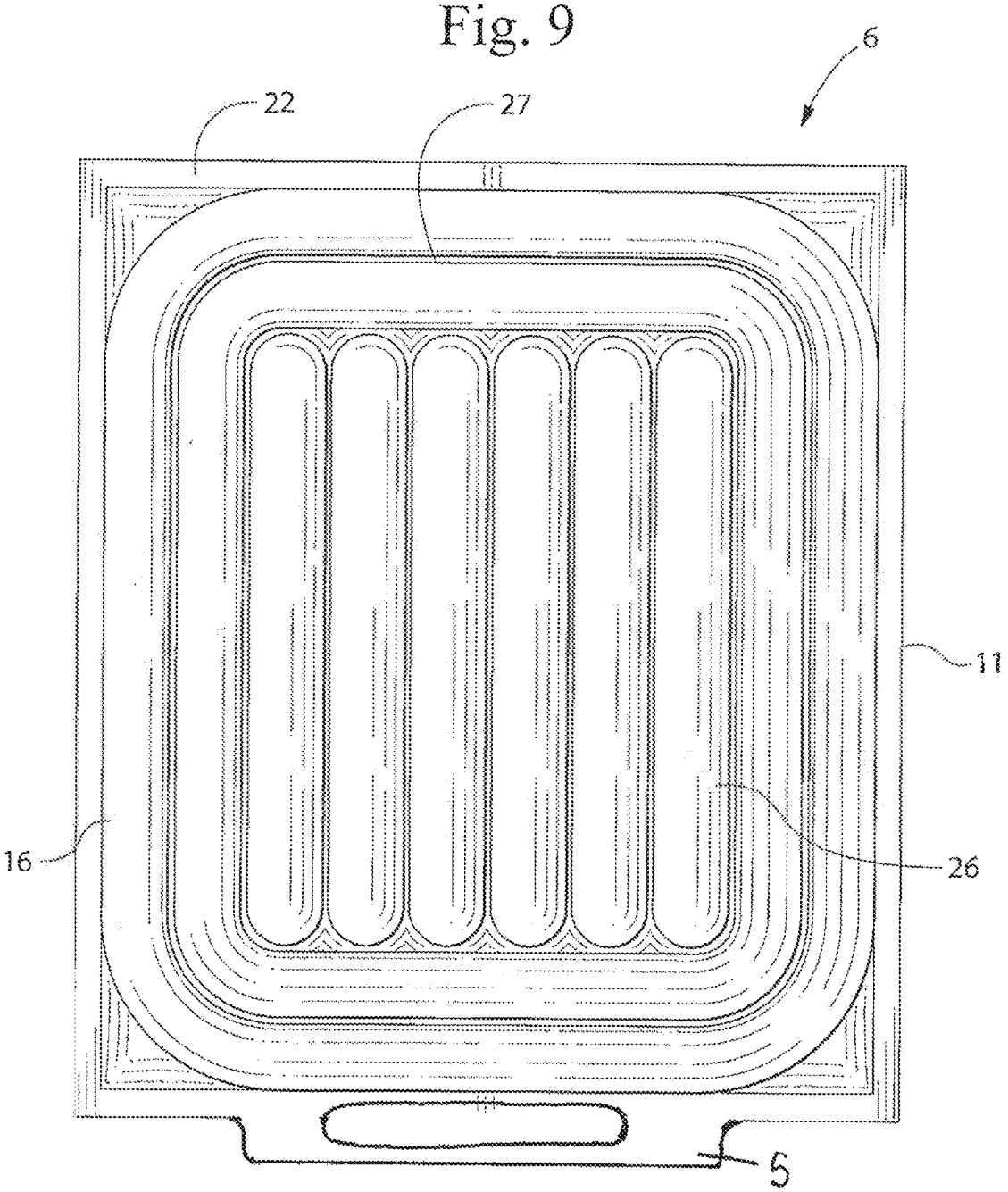
FIG. 9 is a plan view of the flexible package shown in an expanded configuration.

FIG. 9 illustrates a plan view of a flexible package 10 of the type described herein and shown in FIGS. 6-8 in an expanded configuration. The package 10 of FIG. 9 includes a handle 5. The handle 5 can provide an additional convenience for the user of the package 10. The handle 5 can act as part of the package 10 for the user to hold, or can act as a hanger or other handling feature to help the user pick up, carry, move, orient, hang, position or otherwise handle the package 10. The package 10 can have any number of handles 5 and the one or more handles can be integral with any one or more of the sheets forming the package 10. Alternatively, or in addition, the handle 5 may include one or more materials added to the package 10 and may be operatively associated with one or more features of the package 10 such as the article retrieval feature 55, the article reservoir 28, a deflation feature or any other feature of the package 10.

Figure 10:
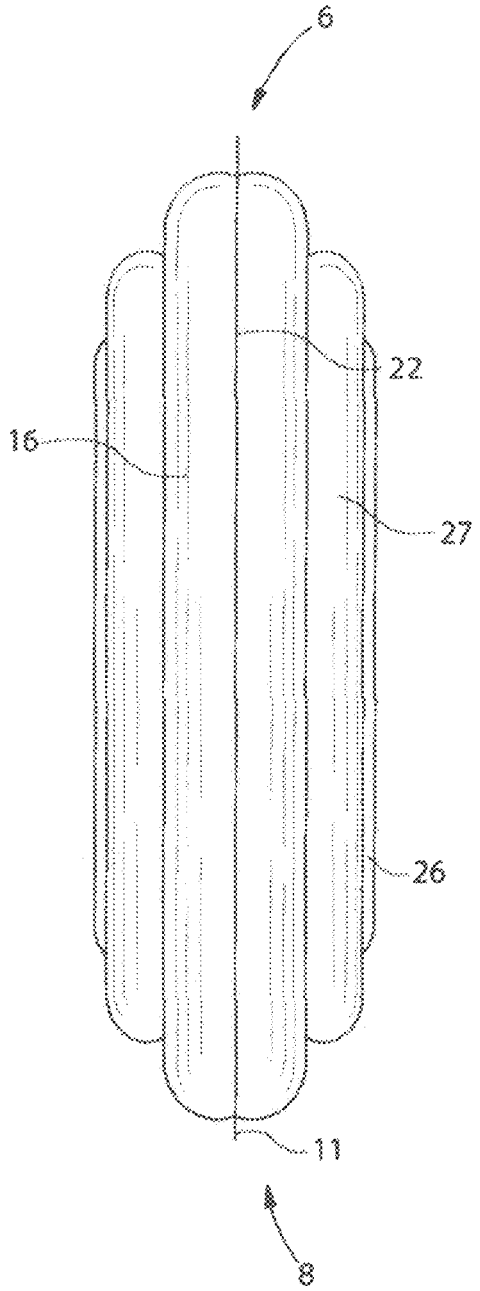
FIG. 10 is a side view of the flexible package shown in an expanded configuration.

FIG. 10 illustrates a side view of the flexible package 10 of FIG. 9. As shown, the package 10 includes exterior seams 22 disposed adjacent the sides 11 of the package 10. The package 10 shown in FIGS. 6-10 is designed and configured to form a generally rectangular parallelepiped when in its expanded state. However, any desired shape can be formed by changing the shape, direction, width and other dimensions of the exterior seams 22, the shape of the sheets that form the package 10 and other seams and structural features.

Figure 11:
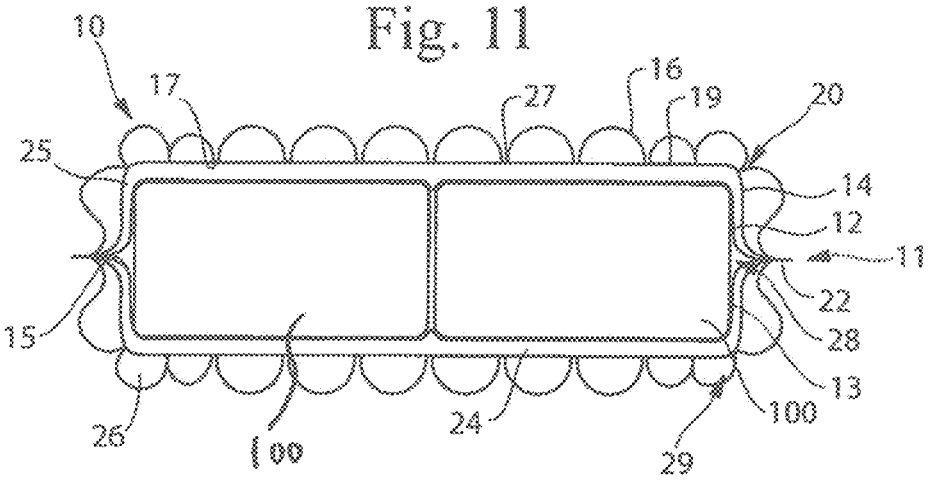
FIG. 11 is a cross-sectional view of the package having two articles inside the article reservoir.

FIG. 11 illustrates a cross-sectional view of a flexible package 10 in accordance with the type disclosed herein, the package 10 being in an expanded state and having articles 100 therein. Article reservoir 28 is formed by the space between the two facing inner sheets 12. The inner sheets 12 have a first surface 13 and a second surface 15 opposed to the first surface. As can be seen, the inner sheet 12 is joined to the outer sheet 14 in at least the area of the exterior seam 22 to form the primary expansion chamber 24. The expansion chamber 24 is in an expanded configuration where an expansion material 25 has been provided into the expansion chamber 24. The expansion material 25 increases the spacing between the sheets forming the volume of the expansion chamber(s) 24 such that the expanded expansion chamber(s) 24 each have a volume that is greater than the expansion chamber(s) 24 volume when not filled with the expansion material 25. At least a portion of the second surface 15 of the inner sheet may be in contact with the article(s) 100 when the primary expansion chamber 24 is in an expanded state.

Further, as shown in FIG. 11, the secondary outer sheet 16 may be joined to the outer sheet 14 along at least the secondary expansion chamber seams 27 to form secondary expansion chambers 26. The secondary expansion chambers 26 may be expanded by providing a secondary expansion material 29 into the secondary expansion chamber 26. The secondary expansion material 29 may be the same or a different material than the primary expansion material 25 used to expand the expansion chamber(s) 24. The secondary outer sheet 16 is also shown as being joined to the outer sheet 14 along the outer seams 22.

Like the primary expansion chamber(s) 24, the secondary expansion chamber(s) 26 may be used to provide structural rigidity, mechanical protection and/or shape to the package 10 when in an expanded configuration. If more than one secondary expansion chamber 26 is provided, the secondary expansion chambers 26 may be independent from each other or in fluid communication with each other. Also, the secondary expansion chamber(s) 26 may be in fluid communication with the primary expansion chamber(s) 24 or they may be separate from each other. They may be in fluid communication at one point during the manufacture and filling of the package 10 and then made separate or discontinuous from each other at some later point in time. This could be done by sealing portions of the chambers and/or by the use or one or more valves to control the flow of fluid between the chambers.

For packages having a single primary expansion chamber 24 and a single secondary expansion chamber 26, it may be desirable for the pressure in the chambers to be equal or different from each other. Further, where the package 10 includes more than one primary expansion chamber and/or more than one secondary expansion chamber 26, it may be desirable that any one of the one or more primary expansion chambers 24 be expanded to a different pressure than any one or more of the remaining primary expansion chambers and/or one or more of the secondary expansion chambers 26. Adjusting the pressure in different expansion chambers can provide the benefit of strengthening portions of the package (e.g. the expansion chambers that create a frame for the package), but allow for more flexible expansion chambers to be disposed, for example, in contact with the articles 100 in the article reservoir 28. Examples include but are not limited to configurations where the primary expansion chambers 24 have a higher internal pressure than the secondary expansion chambers 26, or vice-versa. Some specific, but non-limiting examples include where at least one of the primary expansion chamber(s) 24 have an internal pressure of from about ambient pressure to about 25 psig, from about 1 psig to about 20 psig, about 2 psig to about 15 psig, about 3 to about 8 psig, or about 3 psig to about 5 psig, and at least one of the secondary expansion chamber(s) 26 have an internal pressure of from about ambient pressure to about 25 psig, from about 1 psig to about 20 psig, about 2 psig to about 15 psig, about 3 psig to about 10 psig, about 4 psig to about 10 psig or about 5 psig to about 10 psig, or about 7 psig to about 9 psig. In one example, one or more of the primary expansion chamber(s) 24 have an internal pressure of between about 2 psig to about 8 psig or about 3 psig to about 5 psig and one or more of the secondary expansion chamber(s) 26 have an internal pressure of between about 5 psig and about 10 psig or about 7 psig to about 9 psig.

The inner sheet 12, the outer sheet 14 and/or the secondary outer sheet 16 can be joined to each other in any number of places creating any number, shape and size of expansion chambers. The primary and/or secondary expansion chamber seams 20 and 27 can be of any length, width and shape. The primary and/or secondary expansion chamber seams 20 and 27 can be formed by any suitable method or material. For example, the seams 20, 27 may be formed by glue, heat (e.g. ultrasound, conductive sealing, impulse sealing, ultrasonic sealing, or welding), mechanical crimping, sewing, or by any other known or developed technology for joining sheets of material. The seams 20, 27 can be continuous or intermittent, can be straight or curved, and can be permanent or temporary. The shape of the seams 20, 27 can be used to form the shape of the expansion chambers 24 or 26 alone or in addition to other structural elements. For example, the secondary expansion chambers 26 can be shaped by the secondary expansion chamber seams 27 in combination with additional materials disposed within the secondary chambers 26 or joined thereto. Further, chambers 24, 26 can be shaped by the use of chemical or mechanical modifications to the materials forming the sheets. For example, a portion of the inner sheet 12, outer sheet 14 and/or secondary outer sheet 16 may be heated, ring-rolled, chemically treated or modified to make it more or less flexible, extensible, non-extensible, stronger, weaker, shorter, or longer than prior to treatment.

The expansion chamber(s) 24, 26 can have various shapes and sizes. Part, parts, or about all, or approximately all, or substantially all, or nearly all, or all of the expansion chamber(s) 24, 26 can be straight, curved, angled, segmented, or other shapes, or combinations of any of these shapes. Part, parts, or about all, or approximately all, or substantially all, or nearly all, or all of an expansion chamber 24, 26 can have any suitable cross-sectional shape, such as circular, oval, square, triangular, star-shaped, or modified versions of these shapes, or other shapes, or combinations of any of these shapes. An expansion chamber 24, 26 can have an overall shape that is tubular, or convex, or concave, along part, parts, or about all, or approximately all, or substantially all, or nearly all, or all of a length. An expansion chamber 24, 26 can have any suitable cross-sectional area, any suitable overall width, and any suitable overall length. An expansion chamber 24, 26 can be substantially uniform along part, parts, or about all, or approximately all, or substantially all, or nearly all, or all of its length, or can vary, in any way described herein, along part, parts, or about all, or approximately all, or substantially all, or nearly all, or all of its length. For example, a cross-sectional area of an expansion chamber 24, 26 can increase or decrease along part, parts, or all of its length.

The flexible package 10 may include one or more expansion ports 50. An expansion port 50 may be provided to allow a user to direct an expansion material into one or more of the expansion chambers 24, 26. The expansion port 50 may be an opening between layers of the materials forming the package 10 or may be an opening in any one or more layers that provides fluid communication to one or more of the expansion chambers 24, 26. In one example, a portion of the inner sheet 12 and the outer sheet 14 remain unjoined along a portion of the primary expansion chamber seam 20 to allow the user to introduce an expansion material into the expansion chamber 24. Additionally or alternatively, materials or structures can be placed in desired locations between the sheets to provide the expansion port 50. For example, a valve may be located between two of the sheets before or after they are joined to provide the expansion port 50 through which an expansion material may be introduced into one or more of the expansion chambers 24, 26.

Any one or more expansion ports 50 may be in fluid communication with any one or more expansion chambers 24, 26 and multiple expansion ports 50 may be in fluid communication with any one or more expansion chambers 24, 26. For example, it may be desirable for a single expansion port 50 to allow for introduction of an expansion material into all of the expansion chambers 24, 26 in the package 10. It may also be desirable for a single expansion port 50 to allow for introduction of an expansion material into only some of the expansion chambers 24, 26 in the package 10, such as for example those on one side of the package 10 or those formed between only the same sheets (e.g. inner sheet 12 and outer sheet 14). Further still, several expansion chambers 24, 26 may have different expansion ports 50 to allow for individual expansion of the chambers 24, 26. Individual expansion can be beneficial when different expansion pressures are desired for different expansion chambers 24, 26 and/or if the expansion chambers 24, 26 will be expanded at different times or with different equipment.

Typically, after the user introduces the expansion material through the expansion port 50, the expansion port is temporarily or permanently closed to prevent the escape of the expansion material(s) from the expanded chamber(s) 24, 26. A pressure source may remain in fluid communication with the expanded chamber 24, 26 throughout an operation that closes the expansion port 50 to help maintain the desired pressure in the expansion chamber 24, 26. Any means can be used to close the expansion port, including those described herein with respect to making chamber seams 20 and 27 as well as any other method suitable for closing the particular expansion port 50 that is used. The expansion port 50 may be hermetically sealed closed or not, depending on the desired end use of the package 10. Further, the expansion port 50 may include a closure other than a seal, such as, for example, a valve, a cap, a material to hold the expansion port 50 closed, such as an adhesive, or any other closure or closure means. The closure may be single use (e.g. once closed, can't be opened without damaging the package 10, expansion port 50 or closure, or may be reusable, such as a threaded cap or friction-fit plug or other closure that can be reused one or more times.

In any configuration, it may be desirable to include one or more vents 21 in fluid communication with the article reservoir 28 to allow the vacuum to be applied and/or to allow fluid to escape the article reservoir 28 during or after the expansion of the primary expansion chamber(s) 24. The vent 21 can be sealed after the package is fully constructed or it can remain partially or fully open to allow for fluid flow into and/or out of the article reservoir 28. The vent 21 can be configured to be self-sealing or can be sealed by some separate step and/or tool. The vent 21 can, for example, include a valve and can be one-way or two-way. That is, it can allow fluid to flow in both directions (in and out) or just one direction. One or more vents 21 can also be provided to allow fluid flow to or from other portions of the package 21, as desired.

The package 10 of the present invention includes one or more closeable openings 30 through which one or more articles 100 may be placed into the article reservoir 28. The closeable opening 30 is preferably an unjoined portion of the sheets making up the article reservoir 28. For example, the inner sheets 12 at one end 6, 8 of the package 10 may be left unjoined across all or a portion of the width W of the package 10 to form the closeable opening 30. The closeable opening 30 may be located anywhere on the package 10 and may be configured to best meet the needs of the user. For example, if a larger opening is needed, the closeable opening 30 may be disposed along a side edge 11. Also, the closeable opening 30 may be provided through one or more of the sheets making up the package 10. Thus, for example, the inner sheet 12, the outer sheet 14, and/or the secondary outer sheet 16 may include an opening therethrough to form the closeable opening 30. At a minimum, the closeable opening 30 should provide access to the article reservoir 28 prior to being closed. This allows the user to place the one or more articles 100 in the article reservoir 28 before shipping. In an alternative execution, the article(s) 100 may be placed in the reservoir 28 prior to any of the sheets being joined together or after some, but not all of the sheets are joined together.

The closeable opening 30 may be any size desired by the user and can include any type of closure mechanism 31 or material, if a closure mechanism/material is used. For example, the closeable opening 30 may include an adhesive, mechanical closure, magnets, clips, folding closure device or any other closure mechanism desired by the user. As shown in FIG. 1, the closure mechanism 31 can be joined to package 10 at the closeable opening 30 or any other part of the package 10 or may be separate therefrom. The closure mechanism 31 may be a single-use mechanism or may be reusable. Examples of closure mechanisms include, but are not limited to hook and loop fasteners, zippers, buttons, tapes, adhesives, magnetic strips, sewing, bands, interference-type fasteners and any other types of closure mechanisms suitable for the particular use of the package 10.

Where a distinct closure mechanism 31 is not used, the closeable opening 30 may be closed by sealing the materials located in the region of the closeable opening 30. Such sealing can be done using heat, chemicals, friction, static, sound, or other sources to close the closeable opening 30. It is also possible to provide additional materials in the location of the closeable opening 30 to help provide the desire closure. For example, additional materials with different melting temperatures or strength profiles may be provided. Also, materials like particles, metals, magnets and others may be provided in the area of the closeable opening to allow for sealing of the materials with different equipment and processes. Additionally or alternatively, the closeable opening 30 may be closed by expanding one or more of the expansion chambers 25 or 26.

The closeable opening 30 may be configured to be reusable (i.e. can be open and closed more than one time) or may be a single-use-type opening. Other features may also be included to help make the package more user-friendly. For example, the closeable opening 30 may be a different color from the rest of the package 10 or may include texture, indicia or other features to make it more readily apparent to the user. Also, the closeable opening 30 may have a sheet, coating or other material therein to help the user open the closeable opening 30 when it is time to insert the article(s) 100.

The closeable opening 30 may be configured such that it can be closed at the same time and/or with the same equipment as one or more of the expansion ports 50. For example, the package 10 can be configured such that the closeable opening can be heat seal closed at the same time one or more of the expansion ports 50 is heat seal closed. Alternatively, the closeable opening 50 can be configured to be closed at a different time than the expansion port(s) 50 and/or by different means. Thus, the article(s) 100 can be placed in the package 100 and the closeable opening 30 be closed at a time different than the expansion of the expansion chambers 24, 26. This may allow for better overall results, for example, if the article 100 must be protected from dust, but the package 10 can't be finally expanded for shipment until a time and/or location different from when and where the article 100 is placed in the package 10. In such situations, the closeable opening 30 can be closed after the article 100 is placed in the article reservoir 28 and need not wait to be closed until the expansion chambers 24, 26 are expanded for shipment.

The package 10 may include one or more article retrieval features 55 and/or one or more chamber deflation features 56, as shown in FIGS. 1, 6, 13-16. The article retrieval feature 55 may be used to open the package 10 so that the end user can retrieve the article(s) 100 from the article reservoir 28. The chamber deflation feature 56 may be used to deflate one or more of the primary or secondary expansion chambers 24, 26. As used here, "chamber deflation feature" is used to describe any feature that is used to deflate an expansion chamber, and can include a chamber deflation feature 56 or a combined article retrieval and chamber deflation feature 57. Examples of chamber deflation features 56 include, but are not limited to tear strips; tools to puncture one or more layers of the package 10; openable closures such as, for example, screw on caps, snap on caps, adhesive closures, mechanical closures; and other closure means and mechanisms. Another example includes providing a sticker or other cover material over a hole in one or more of the expansion chambers 24, 26 that can be removed to release the expansion material 25.

Figure 14:
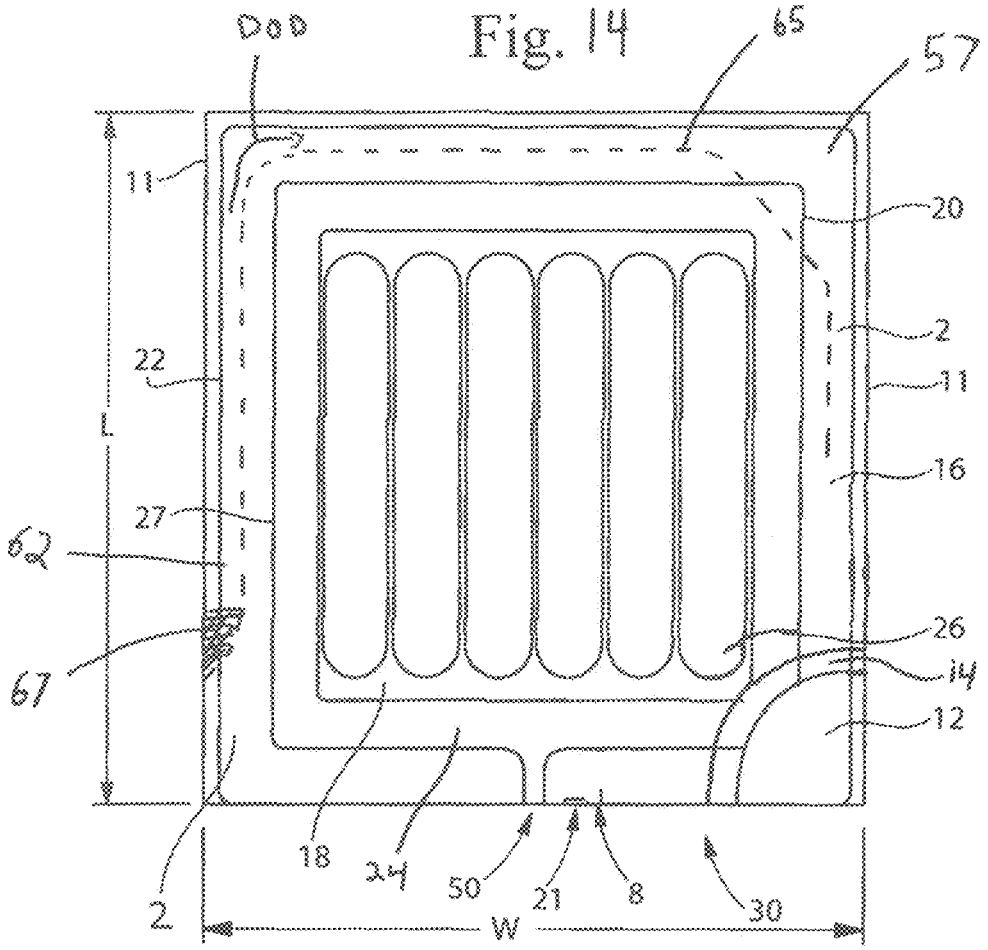
FIG. 14 is a plan view of one panel of a flexible package of the present invention in a deflated state.
Figure 15:
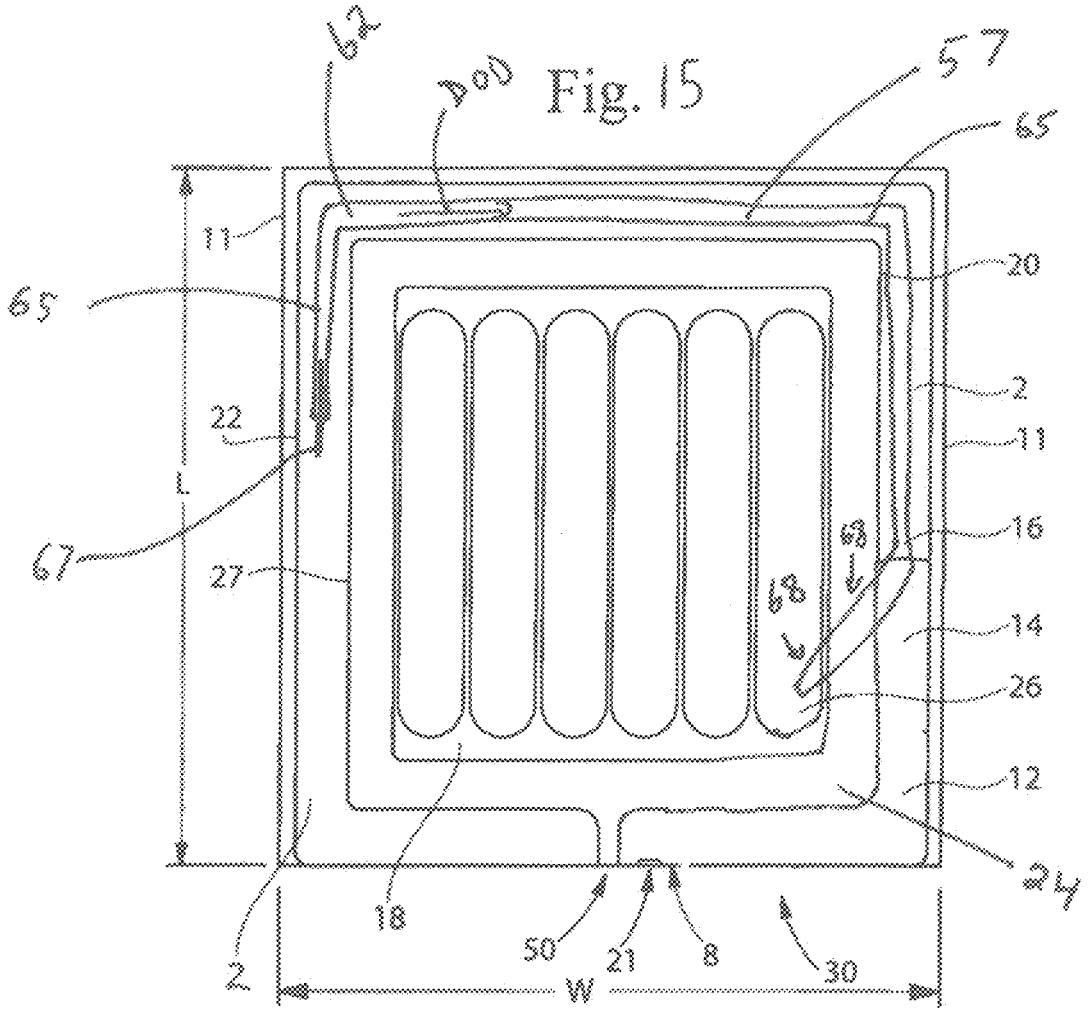
FIG. 15 is a plan view of one panel of a flexible package of the present invention in a deflated state.

The package 10 may include any desired number of article retrieval members 55 and/or chamber deflation features 56, and they can be located anywhere on the package 10, including on an outer surface such or on a surface within the article reservoir 28. It may be desirable that there is only a single article retrieval feature 55 and only a single chamber deflation feature 56. However, there may be situations where two or more article retrieval features 55 are desired, for example, to make the package 10 easier to use and/or to allow for retrieval of articles 100 from different article reservoirs 28 or different regions of the article reservoir 28. Further, there may be situations where it is desired to have a single article retrieval feature 55 and multiple chamber deflation features 56 or vice versa. Even further, it may be desirable that a single element provides for both article retrieval and chamber deflation. Such a combined article retrieval feature and chamber deflation feature is shown in FIGS. 14 and 15, and is referred to herein as a combined retrieval and deflation feature 57. One or more combined article retrieval and deflation features 57 can be combined with one or more article retrieval features 55 and/or one or more chamber deflation features 56.

As noted, it may be desirable for the package 10 to include a combined article retrieval and chamber deflation feature 57. In such embodiments, the combined article retrieval and chamber deflation feature 57 can be operatively associated with one or more of the expansion chambers 24, 26. That is, when the package 10 is opened using the combined article retrieval and chamber deflation feature 57, one or more of the expansion chambers 24, 26 are also opened, allowing the expansion material to escape. This configuration may be preferred when the end user intends to deflate or return the package 10 to its unexpanded state once the article 10 is retrieved. As noted, the combined article retrieval and chamber deflation feature 57 can be operatively associated with one or more of the expansion chambers 24, 26 to provide for immediate or extended release of the expansion material. Further, the combined article retrieval and chamber deflation feature 57 can be configured to release the pressure or deflate one or more of the expansion chambers 24, 26 at a different time or rate than one or more of the other expansion chambers 24, 26 and/or at any time during the package opening or article retrieval process.

The article retrieval feature 55, chamber deflation feature 56, and/or combined article retrieval and chamber deflation feature 57 may comprise any element, means, structure, or the like that can be used to open the desired portion of the package and allow, for example, for the user to gain access to the article(s) 100 in the article reservoir 28, deflation of one or more expansion chambers, or both. Examples of mechanisms and devices that may be used in article retrieval features 55 include, tear strips, lines of weakness, perforations, sharp tools, and other mechanisms and devices that can be used to open the package 10 or deflate one or more of the expansion chambers, or both. However, other article retrieval features 55 are contemplated that do not require tearing or damaging of the package 10, including zippers, adhesive flaps, articulatable openings, mechanical closures, lids, caps, etc.

It may be desirable that the article retrieval feature 55, chamber deflation feature 56 and/or combined article retrieval and chamber deflation feature 57 forms part of the package 10 so that no additional tools are needed to access the article(s) in the article reservoir 28 and/or to deflate one or more of the expansion chambers. Alternatively, a tool that can be used to open the package 10 can be attached to the package 10, disposed in the package 10, made part of the package or otherwise provided for ease of opening such packages 10 or deflation of one or more expansion chambers, or both. The tool, if used, can be reusable, disposable or single-use.

If the article retrieval feature 55, chamber deflation feature 56 and/or combined article retrieval and chamber deflation feature 57 forms part of the package or is otherwise integral therewith, it may be desirable that it remains attached to the package 10 after use. For example, it may be desirable that a tear strip used as a combined article retrieval and chamber deflation feature 57 remain attached to the package 10 after it is deployed to open the package 10 and/or deflate one or more of the expansion chambers. Alternatively, it may be desirable that one or more of any such the article retrieval feature 55, chamber deflation feature 56 and/or combined article retrieval and chamber deflation feature 57 be permanently or temporarily separable from the package 10 after use. In some situations, this may provide for easier disposal or recycling (e.g. tear tab is made of different material than package)

The article retrieval feature 55, the chamber deflation feature 56, and/or the combined article retrieval and chamber deflation feature 57 may be configured to permanently destroy the package 10 or any part thereof. For example, any one for them may, when deployed, render the package 10 unfit for re-use. This could be due to tearing of some part of the package 10 or by otherwise rendering one or more of the expansion chambers 24, 26 or the article reservoir 28 unusable. Alternatively, the article retrieval feature 55, the chamber deflation feature 56, and/or the combined article retrieval and chamber deflation feature 57 can be configured to be reusable and allow for the package 10 to be reused as a shipping package or for some other use. For example, the article retrieval feature 55, chamber deflation feature 56, and/or combined article retrieval and chamber deflation feature 57 may be configured to allow retrieval of the article(s) 100 contained in the package 10, but not deflate some or any of the expansion chambers 24, 26 so that the same article(s) 100 may be shipped again (e.g. returned) in the same package 100. Alternatively, the package 10 may be reused for shipping different articles and/or for shipping, displaying, storing or otherwise using the package for some predetermined use after one or more of the article retrieval features 55, chamber deflation features 56, and/or the combined article retrieval and chamber deflation features 57 are deployed.

As noted above, the package 10 may include any number of article retrieval features 55, chamber deflation features 56, and/or combined article retrieval and chamber deflation features 57 and they can be located anywhere on the package 10. For simplicity and to prevent the disclosure from having to repeat the same information several times, certain embodiments are disclosed herein that specifically describe characteristics of one or more of the article retrieval features 55, chamber deflation features 56 and/or combined article retrieval and deflation features 57, however, it should be noted that any such disclosure should be considered to disclose the same information as it would relate to the other of the article retrieval feature 55, chamber deflation feature 56 and/or combined article retrieval and chamber deflation feature 57 that is not specifically set forth. That is, a description of a particular embodiment including an article retrieval feature 55 should be considered to disclose the same information as it would relate to a chamber deflation feature 56 and/or a combined article retrieval and chamber deflation feature 57 and vice versa unless explicitly described as otherwise.

Figure 13:
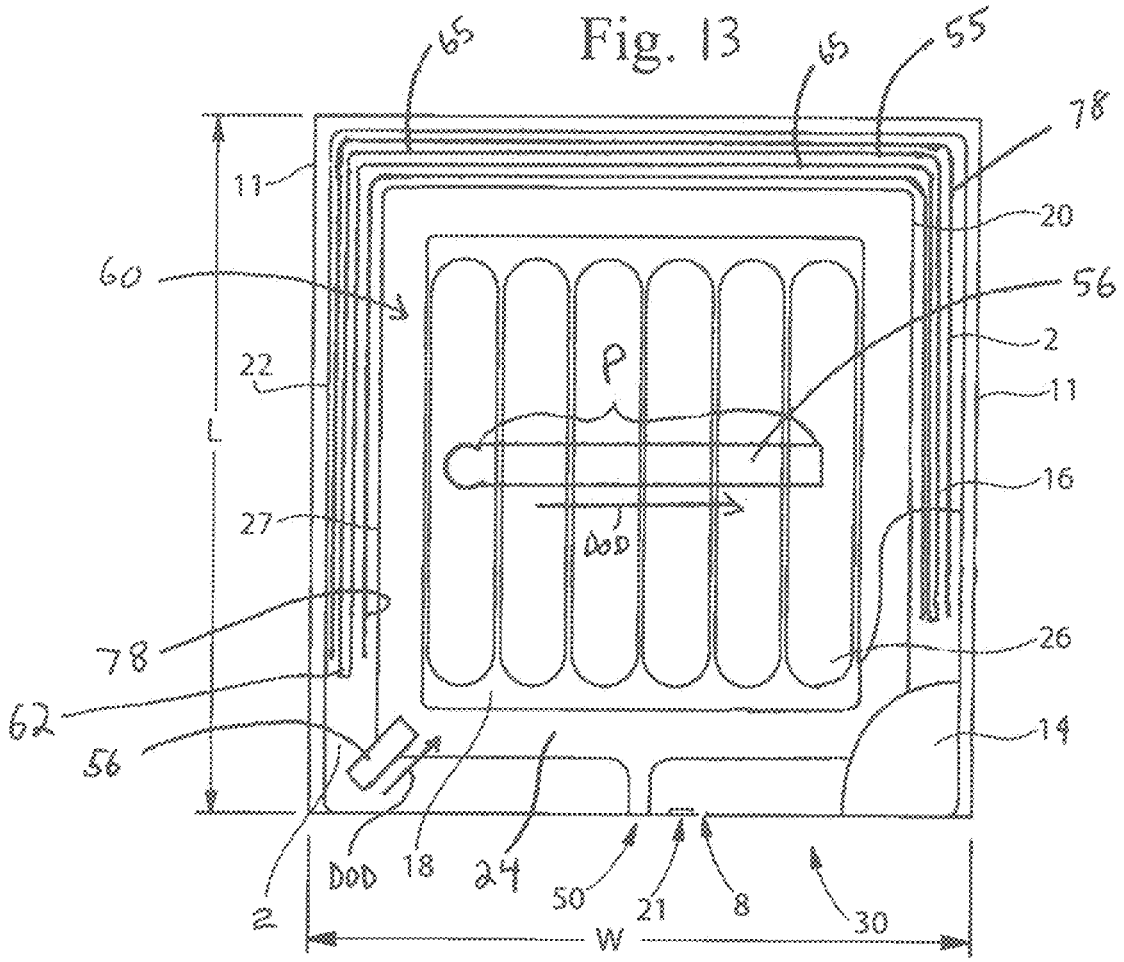
FIG. 13 is a plan view of one panel of a flexible package of the present invention in a deflated state.

FIG. 13 shows an example of a package 10 that includes an article retrieval feature 55 that is disposed only on a first panel 60 of the package formed from the top portion 2 and extends along at least a portion of two or more sides of the package 10. As used herein, the term "panel" refers to a section of the package 10 that can be distinguished from other sections by seams and/or folds. For example, the article retrieval feature 55 may extend along a portion of one or more of side edges 11 and at least a portion of end edge 6. In embodiments where the package 10 is generally parallelepiped and the article retrieval feature 55 extends along substantially all of three edges, the package 10 may be opened like a clam-shell. This may be particularly useful for the person opening the package 10 if the articles contained therein are large, heavy, bulky, irregularly shaped or otherwise difficult to remove from the package 10. In other embodiments, it may be desirable for the article retrieval feature 55 to extend along only a portion or the entirety of a single side of the package, along only a portion or the entirety of two sides of the package, along a portion of three or more sides of the package, or completely around at least a portion of one panel of the package 10. The article retrieval feature 55 may be disposed on a single panel of the package 10 or may have portions that extend into two or more panels.

The article retrieval feature 55 may be configured such that it provides access to the article reservoir 28 when deployed, but does not deflate or otherwise interfere with any of the expansion chambers. In such configurations, it is possible to open the package 10 to retrieve any articles 100 therein, but to not otherwise deflate, damage or destroy the package 10. Thus, it can allow for reuse of the package 10. This is especially beneficial for product returns and for packages 10 that are intended to be used to display, store, or provide some other functional property to the articles 100 therein.

The package 10 shown in FIG. 13 also includes two separate chamber deflation members 56, one of which is operatively associated with the primary expansion chamber 24 and one that is operatively associated with the secondary expansion chambers 26 disposed in the first panel 60. As used in this context, "operatively associated" means that a particular feature is located and configured such that it can effectively interact with the other feature it is operatively associated with to provide the desired function. In this example, the chamber deflation member 56 is located and structured such that its deployment deflates the one or more primary and/or secondary expansion chambers 24, 26 with which it is operatively associated.

The article retrieval feature 55 may be operatively associated with one or more of the primary or secondary expansion chambers 24, 26 (forming a combined article retrieval and deflation feature 57). As shown in FIG. 14, the article retrieval feature, in this case article retrieval and chamber deflation feature 57 is operatively associated with primary expansion chamber 24. As shown in FIG. 15, the article retrieval feature 55 is operatively associated with primary expansion chamber 24 and secondary expansion chamber 26.

In configurations including a chamber deflation feature 56 or a combined article retrieval and chamber deflation feature 57, it may be desirable that one or more of the expansion chambers 24, 26 is deflated before one or more other expansion chambers and/or that the expansion chambers are deflated in a particular order. This can be achieved by predetermining the path P and direction of deployment DOD along which the article retrieval feature 55 is intended to be deployed and locating the expansion chambers desired to be deflated first earlier in the path P of the article retrieval feature 55. The path P may be generally straight, may be curved and/or may change directions one or more times. It may also be desirable that any one or more of the expansion chambers be operatively associated with the article retrieval feature 55 at more than one location along the path P. This can be helpful, for example, to ensure that the chamber can be fully deflated even if the package 10 is deformed or crumpled during use or during the opening process.

As noted above, the article retrieval feature 55 may take on any suitable form, including, but not limited a tear strip 62, such as shown in FIGS. 13-16. If a tear strip 62 or the like is used, it can be formed by providing one or more lines of weakness 65 in one or more of the materials making up the package 10 at the desired location. A line of weakness can be provided by scoring or perforating one or more of the materials or by otherwise weakening one or more of the materials continuously or intermittently along a particular line or path. Scoring, perforating and other forms of weakening can be achieved by any known or developed means and can be performed before or after the materials of the package 10 are joined together, seamed, etc. Further, a line of weakness 65 can be provided on any surface of a material, including one side of a sheet or layer, both sides, the exterior surface(s) or within one or more layer or surface(s). Examples of known means for creating lines of weakness include but are not limited to embossing; heating; etching (chemical, thermal, light, and/or mechanical); cutting or scoring using heat, light, laser, air, water, sharp edges; folding; treating with materials; joining materials that separate from each other with less force than tearing either of the materials; joining materials with a material that will separate from itself or the other materials with less force than required to tear either of the joined materials; delaminating layers of multi-layer materials in selected regions; and combinations thereof.

The tear strip 62 can be formed from the material of the package 10, from a material added to the package 10 or both. For example, a tear strip 62 can be formed by a single line of weakness 65 that separates the tear strip 62 from the remainder of the package 10 (shown in FIG. 14). Alternatively, a tear strip 62 may be formed between two lines of weakness 65 such that when deployed, the tear strip is created by the material disposed between the two lines of weakness 65 (shown in FIGS. 13 and 15). Further still, a portion of or the entire tear strip 62 may include an additional material 67 (e.g. shown in FIGS. 14 and 15), for example a string, tape or other typically linear material, that is joined to the package 10 along the line of weakness 65 and is also joined to the material making up at least a portion of the package 10 such that when the tear strip is deployed, the additional material 67 and at least some of the material making up a portion of the package 10 is at least partially separated from the rest of the package 10 along the one or more lines of weakness 65. The additional material 67 may act as a tab to allow the user to grasp the additional material 67 easily and/or may provide strength, color, texture, visible indicia, or other desirable characteristics to the tear strip 62 or any portion thereof.

Figure 16:
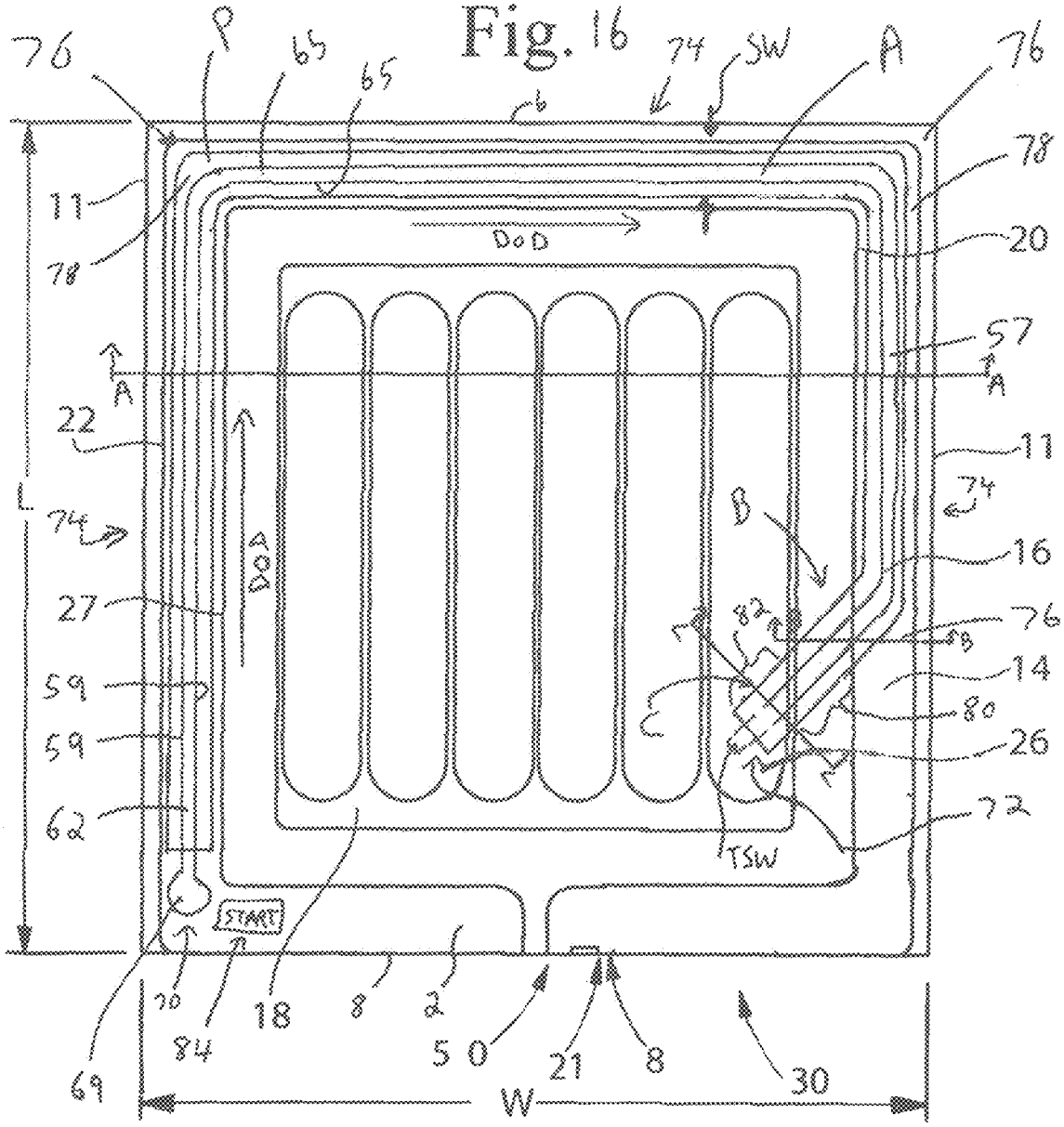
FIG. 16 is a plan view of one panel of a flexible package of the present invention in a deflated state.

FIG. 16 is a simplified plan view of an exemplary embodiment of the package 10 of the present invention in a pre-expansion state. The package 10 has exterior seams 22, side edges 11 and opposing end edges 6 and 8. The package 10 includes a combined article retrieval and chamber deflation feature 57 in the form of a tear strip 62. The tear strip 62 is formed by lines of weakness 65 that are spaced apart by the tear strip width TSW. The tear strip 62 extends along the majority of the side edges 11 and the end edge 6 of the package inboard of the exterior seams 22. The tear tab 62 has a grip tab 69 disposed at one end of the tear strip 62, specifically, the originating end 70. The path P of the tear strip 62 extends from the originating end 70 to the terminating end 72. In use the tear tab 62 is intended to be deployed by taking hold of the grip tab 69 and pulling it up and away from the surface of the package 10. The tear strip 62 is then pulled along the path P in the direction of deployment DOD until the terminating end 72.

In the example shown in FIG. 16, the tear strip 62 extends through several generally straight linear sections 74 and through several non-linear sections 76. As used herein, "non-linear" refers to something that is not in a straight line, and includes the transition regions between linear regions and non-linear regions. In order to ensure that the tear strip 62 performs as desired and follows the predetermined path P, it may be desirable or necessary to configure the tear strip 62, lines of weakness and/or surrounding portions of the package 10 in different ways in different regions. For example, it may be desirable to reduce the tear strength of the package 10 in non-linear sections 76 or it may be desirable to increase the tear strength of the tear strip 62 in such regions, or both. Alternatively, or in addition, if lines of weakness 65 are used, the lines of weakness 62 can be configured to have different characteristics along different portions of the tear strip 62. For example, it might be desirable to weaken the package material more in the non-linear sections 76 that in the linear sections 74. Doing so can help ensure that the tear strip 62 follows the desired path P and yet, does not prematurely separate from the package 10. This can be especially important when the material making up the package 10 includes more than one layers of material as the multiple layers can act inconsistently or can slide relative to each other. One way to change the strength of a line of weakness 65 is to change the number or depth of perforations or scores along different portions of the line of weakness 65. Generally, the more material that is removed from the line of weakness 65, the weaker it is. This can be done by providing more apertures 90 or scores 92 per unit area, providing larger apertures 90 or scores 92 and/or providing deeper apertures 90 or scores 92. Alternatively, this can be done by scoring the material from both sides.

Another feature that can impact the performance of a tear strip 62, especially for multi-layer materials is how and where the materials are joined together. Joining materials together along some or all of the path P of the tear strip 62 can help prevent the tear strip 62 from deviating from its intended path P and can also help provide the desired tear strength and feel for the consumer. In addition, joining some layers and not others in certain regions can provide for unique characteristics when using a tear strip 62, including different depths of tear, access to different chambers within the different layers and even different tear characteristics. As shown in FIG. 16, it may be desirable to provide an opening feature seam 78 along some or all of the path P of the opening feature, be it an article retrieval feature 55, a chamber deflation feature 56 or a combined article retrieval and chamber deflation feature 57. The opening feature seam 78 can be disposed along all or a portion of one or both sides 59 of the opening feature, can span some or all of the tear strip width TSW, or can be a width that is greater that the tear strip width TSW and extend outwardly from the tear strip 62 on one or both sides 59. For example, as shown in FIG. 13, the package 10 includes an opening feature seam 78 separate from but on both sides of the opening feature, in this case, article retrieval feature 55. In such configurations, the opening feature seams 78 can act as "rails" to help direct the path of the article retrieval feature 55 as it is deployed.

In another example, as shown in FIG. 16, the opening feature seam 78 extends along substantially the entirety of the tear strip path P, across the tear strip width TSW and outwardly from each of the sides 59 of the tear strip 62. In such configurations, the width SW of the opening feature seam 78 can be chosen to fit the needs of the particular opening feature, but typically, it is desirable for the opening feature seam width SW to be enough to allow for small deviations in the manufacturing process, including the process or processes used to create the opening feature and/or lines of weakness 65. Additionally, the seam width SW can provide for sealing of layers or sheets of material around the line of weakness, 65, for example, around perforations used to create the line of weakness 65. In one non-limiting embodiment, the opening feature seam 78 may have a seam width SW of about 5 mm, but the seam width SW may be any desired size, such as, for example, exactly, about, or less than or equal to about any of the following: 50 mm, 40 mm, 30 mm, 20 mm, 10 mm, 8 mm, 7.5 mm, 5 mm 4 mm, 2.5 mm, 2 mm, 1.5 mm, 1 mm, 0.5 mm, or 0.1 mm. The opening feature seam 78 can be made by any known method, including but not limited to those set forth herein with respect to other seams in the package 10. The opening feature seam 78 can comprise a single seam through one or more layers of material or may include seams on individual layers that are adjacent or overlapping. Seaming of different layers can be done together or separately, depending on the method and equipment used to make the package 10. In certain configurations, it may be desirable or necessary to add materials in or between layers to help control the sealing. For example, although PE is often preferred for packaging due to its recyclability, it does not absorb laser energy very well compared to other thermoplastic materials. Thus, if a laser is being used to form the opening feature seam 78, it may be desirable or necessary to add a material within or between the layers or sheets to improve the seaming characteristics of the material in that region. Also, additives can be used to prevent absorption of heat, light or other energy to prevent joining of materials where it is not desired to do so.

Figure 16A:
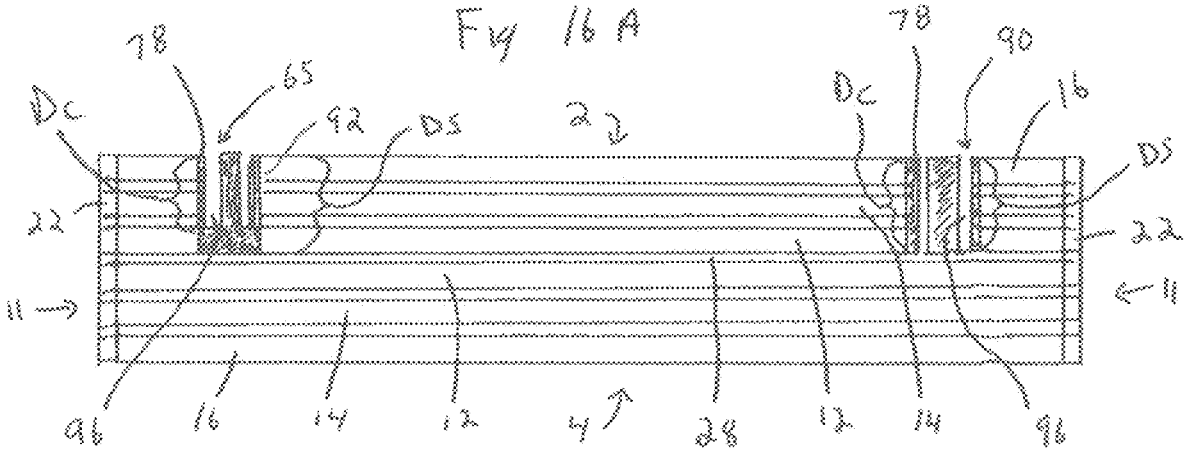
FIG. 16A is a cross-sectional view the flexible package of FIG. 16 taken through 16A-16A.
Figure 16B:
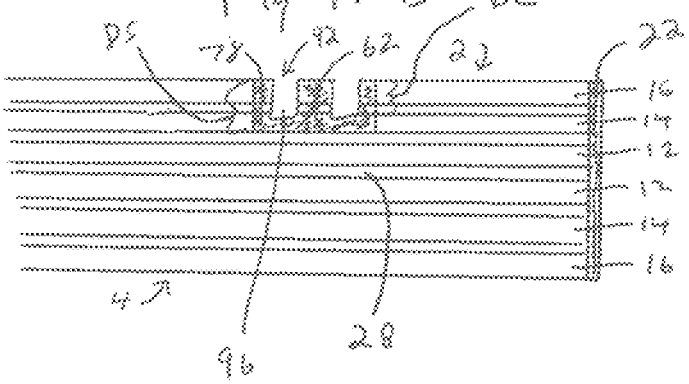
FIG. 16B is a cross-sectional view the flexible package of FIG. 16 taken through 16B-16B.
Figure 16C:
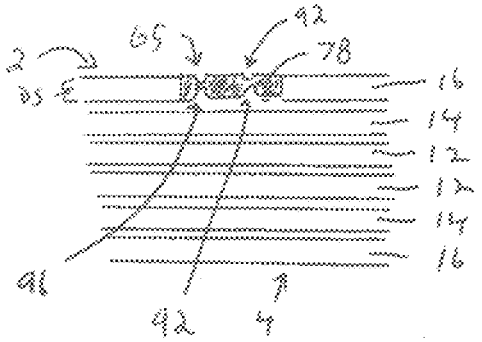
FIG. 16C is a cross-sectional view the flexible package of FIG. 16 taken through 16C-16C.

FIGS. 16A-16C show cross-section views of the package 10 of FIG. 16 with 16A representing the cross-section through line 16A-16A, 16B the cross-section through 16B-16B, and 16C the cross-section through 16C-16C. As shown in FIG. 16, the package 10 has a tear strip 62 that extends through several linear regions 74, several non-linear regions 76, a primary expansion chamber release region 80 and a secondary expansion chamber release region 82. Although the different portions and regions are shown in particular locations on the package 10, it is to be understood that this example is a non-limiting example and that such different regions can be different in number and/or location from that which is shown. In the example shown, the tear strip 62 has a package opening portion A that is intended to provide access to the article reservoir 28, a primary expansion chamber deflation portion B that is operatively associated with and intended to deflate one or more of the primary expansion chambers 24, and a secondary expansion chamber deflation portion C that is operatively associated with and intended to deflate one or more secondary expansion chambers 26. In this embodiment, the function of the tear strip 62 in different regions is affected by the depth DS of the opening feature seam 78.

As shown in FIG. 16A, the opening feature seam 78 joins the inner sheet 12, the outer sheet 14, and the secondary outer sheet 16 together along the path of the tear strip 62 in the package opening portion A of the path P. As shown in FIG. 16B, the opening feature seam 78 joins the outer sheet 14 and the secondary outer sheet 16 along the path of the tear strip 62 in the primary expansion chamber deflation portion B of the path P. As shown in FIG. 16C, the opening feature seam 78 is contained within the secondary outer sheet 16 along the path of the tear strip 62 in the secondary expansion chamber deflation portion C of the path P. This configuration allows the user to pull and deploy a single opening feature, tear strip 62, to open the package 10, to deflate the primary expansion chamber(s) 24 and to deflate the secondary expansion chamber(s) 26. Further, because the tear strip 62 has a predetermined path P, starting at the originating end and finishing at the terminating end 72, this particular configuration of seams allows for deflation of the primary expansion chamber(s) 24 and the secondary expansion chamber(s) 26 at the end of the package opening process. Changing the depth DS of the opening feature seam 78, the location and/or the layers joined by the opening feature seam 78 can change the tear strength required to open the package 10, change the point at which one or more of the primary expansion chamber(s) 24 and/or secondary expansion chamber(s) 26 are deflated, including at the originating end 70 of the tear strip 62, at the terminating end 72 and/or anywhere in-between.

In addition to the opening feature seam 78, the line(s) of weakness 65 can affect the characteristics of the opening feature. For example, as mentioned above, the size, shape, density, depth and location of the line(s) of weakness 65 can affect the force needed to deploy the opening feature, such as tear strip 62. Further, if multiple lines of weakness 65 are employed, they can define the tear strip 62. The lines of weakness 62 can also be configured such that they improve directional stability of the tear strip 62 during use and/or provide for separation of different layers or sheets of material. In particular, for packages like those described herein, where certain portions of the package 10 may be expanded or inflated, it may be desirable or necessary to ensure that any lines of weakness 65 overlying or touching any expansion chambers not extend through the entire layer or layers of material making up the expansion chamber. In such configurations, it may be desirable to employ scoring or other means to provide the line(s) of weakness 65 as opposed to a cut or aperture that extends through the entire thickness of the material or materials. Alternatively, it may be possible to use apertures in such situations if the material surrounding the aperture is sealed in an air-tight manner so as to not let the expansion material escape.

In the exemplary embodiment shown in FIGS. 16A-16C, the line of weakness 65 is formed by forming a line of weakness 65 in material of the package 10 in the region of the opening feature seam 78. The line of weakness 65 may be formed by any means and may include one or more apertures 90, one or more scores 92 or combinations of different types of weakening features to get to the desired properties for any particular package 10. The depth DC of the cavity 96 formed by the weakening feature (e.g. aperture 90, score 92, etc.) is different in different portions of the tear strip 62. (In configurations where a cavity 96 is formed on two opposing sides of a material and the cavities are generally aligned, the depth DC of the cavity DC is the sum of the depths DC of the two opposing cavities 96.) As shown in FIGS. 16A-C, the depth DC of the cavity is different in the different regions shown in the cross-sections of the figures. For example, the depth DC of the cavity 96 is greater in the package opening portion A of the tear strip 62 than the primary expansion chamber deflation portion B of the tear strip 62, which is less than the depth DC of the cavity in the secondary expansion chamber deflation portion C. This particular configuration allows the article retrieval feature 55, in this case an article retrieval and chamber deflation feature 57 to tear through the layers of the package 10 necessary to provide access to the article reservoir 28 in opening portion A, allows for deflation of the primary expansion chamber 24 in the primary expansion chamber deflation portion B without deflating the secondary expansion chamber 26 and allows for the secondary expansion chamber 26 to be deflated in the secondary expansion deflation portion C.

Also, it may be desirable the depth DC of the cavities 96 be greater or lines of weakness 65 be provided on opposing sides of one or more layers of the material making up the package 10 in regions where the path P changes direction, such as non-linear regions 76, to reduce the strength of the lines of weakness 65 in that area and help ensure the tear strip 62 follows the path P in that region when activated. The same may be desirable where there are changes in the layers that are seamed and/or joined together, such as, for example, where there are multiple deflation passages 68 along the path P of the opening feature because such changes and/or deflation passages 68 can provide regions where the tear strip 62 may tend to exit the predetermined path P if the strength of the line of weakness 65 is not reduced in that area. Of course, different cavity depths DC can be used in the same or different regions to provide the desired effects. Yet another way to affect the performance of the tear strip 62 is to orient the molecules of the material used in the region of the lines of weakness 65 so as to help ensure the tear strip follows the desired path P.

The grip tab 69 or any other portion of the tear strip 62 can include indicia 84 to indicate that it is the starting point or ending point for opening the package or indicia 84 can be provided on another part of the package 10 to indicate as such. (As used herein, the term "indicia" can be a single indicium or multiple indicia and is not intended to be limiting in any way with respect to the number of elements that might make up the indicium or indicia.) In addition, or alternatively, indicia 84 can be provided on the other parts of the package 10 and/or article retrieval feature 55 to indicate information about the package or contents, including how to open the package 10, how to deflate the package 10, how to configure the package 10 for disposal or reuse, or any other information that would be useful to the user. Alternatively, or in addition to indicia 84, the deflation itself or sound thereof of one or more of the expansion chambers can be a signal to the user of relevant information, such as, for example, the article retrieval feature 55 has been fully deployed. In addition, the grip tab 69 may be pre-cut such that it has one end not attached to the package 10 or it may be formed in a way that it must be separated from the package 10 by the user like the rest of the tear strip 62. The grip tab 69 may be partially pre-cut, perforated or the like, to allow the consumer to easily separate it from the package 10, but ensure that it does not come loose during use. Further, the tear strip 62 may have any portion covered by another material, such as a sticker or tape, so as to help prevent either the grip tab 69 from becoming disposed away from the package or to help prevent pre-mature separation of any portion of the line of weakness 65.

As noted herein, it may be desirable to predetermine the rate of deflation for any particular expansion chamber or combination of expansion chambers. For example, it may be desirable that one or more of the primary expansion chambers 24 or secondary expansion chambers 26 deflate at a rate that is greater than or less than the rate of one or more other expansion chambers. This may provide better handling of the package 10 when opening or may provide some other benefit, such as reduced noise, no "pop" sound, a unique "pop", whistle or other sound when deflation occurs or to help ensure the expansion chambers fully deflate upon deploying the chamber deflation feature 57. One way to affect the rate of deflation is to control the size of the deflation passage 68 formed between the chamber deflation feature 56 and the expansion chamber. As used here, "chamber deflation feature" is used to describe any feature that is used to deflate an expansion chamber, and can include a chamber deflation feature 56 or a combined article retrieval and chamber deflation feature 57. Larger deflation passages tend to provide for quicker deflation. In addition to changing the size of the deflation passage 68, the number of deflation passages 68 may be increased or decreased to affect a change in the deflation rate of any one or more expansion chambers. Further, the configuration of the chamber(s) can also affect the rate of deflation. For example, an expansion chamber may be shaped in a way that deflation is slowed. One way to do that is to have sharp corners in the expansion chamber, to have areas of reduced width, and/or to include valves within the expansion chamber or deflation passage 68. Further still, the order of deflation can affect the rate of deflation of any particular expansion chamber or chambers. For example, a lower internal pressure expansion chamber could be released first allowing the higher internal pressure expansion chamber(s) to "press" against the lower pressure expansion chamber and help expel the expansion material therein.

The package 10 may include a dispenser which can be configured to dispense one or more products from one or more of the reservoir 28 disposed within the package 10. The dispenser may be disposed anywhere on the package 10, as desired and can take on any form such as an opening, a nozzle, a spout, a sprayer, a unit dose dispenser, a trigger dispenser or any other desired dispenser.

The package 10 can be made from a variety of materials. Such materials may include, for example and without limitation, films, woven materials, non-woven materials, paper, foil, and/or any other flexible materials. In fact, an advantage of the package 10 of the present invention is that it can be made substantially, almost entirely or entirely from flexible materials but still provide the rigidity, strength and protection needed to successfully and economically ship consumer products through established parcel and mail delivery systems. For example, the package 10 may comprise or be manufactured only of one or more film materials without the need for additional rigid interior or exterior elements, such as wood, metal, solid foam or rigid plastic or a paperboard box, to provide shape and/or structure to the package 10. Stated differently, the package 10 may consist of, or consist essentially of flexible materials. This can be advantageous for both manufactures and consumers as flexible materials such as sheets of film are often easier to handle, ship and store than more bulky items like paperboard boxes and other structural packaging members.

If films are used, the films may include, for example, polyethylene, polyester, polyethylene terephthalate, nylon, polyproplene, polyvinyl chloride, and the like. The sheets may include and/or be coated with a dissimilar material. Examples of such coatings include, without limitation, polymer coatings, metalized coatings, ceramic coatings, and/or diamond coatings. The sheets may be plastic film having a thickness such that the sheets are compliant and readily deformable by an application of force by a human. The thicknesses of the inner, outer and secondary outer sheets 12, 14 and 16, respectively, may be approximately equivalent. Alternatively, the thicknesses of the sheets may be different.

The materials making up the sheets may be laminates that include multiple laminated layers of different types of materials to provide desired properties such as strength, flexibility, the ability to be joined, and the ability to accept printing and/or labeling. The materials, for example, may have a thickness that is less than about 200 microns (0.0078 inches). One example of a film laminate includes a tri-layer low-density polyethylene (LDPE)/Nylon/LDPE with a total thickness of 0.003 inches.

Other types of laminate structures may be suitable for use as well. For example, laminates created from co-extrusion, or coat extrusion, of multiple layers or laminates produced from adhesive lamination of different layers. Furthermore, coated paper film materials may be used. Additionally, laminating nonwoven or woven materials to film materials may be used. Other examples of structures which may be used include, but are not limited to: 48 ga polyethylene terephthalate (PET)/ink/adh/3.5 mil ethylene vinyl alcohol (EVOH)-Nylon film; 48 ga PET/Ink/adh/48 ga MET PET/adh/3 mil PE; 48 ga PET/Ink/adh/.00035 foil/adh/3 mil PE; 48 ga PET/Ink/adh/48 ga SiOx PET/adh/3 mil PE; 3.5 mil EVOH/PE film; 48 ga PET/adh/3.5 mil EVOH film; and 48 ga MET PET/adh/3 mil PE.

The sheets may be made from sustainable, bio-sourced, recycled, recyclable, and/or biodegradable materials. Non-limiting examples of renewable polymers include polymers directly produced from organisms, such as polyhydroxyalkanoates (e.g., poly(beta-hydroxyalkanoate), poly(3-hydroxybutyrate-co-3-hydroxyvalerate, NODAX™), and bacterial cellulose; polymers extracted from plants and biomass, such as polysaccharides and derivatives thereof (e.g., gums, cellulose, cellulose esters, chitin, chitosan, starch, chemically modified starch), proteins (e.g., zein, whey, gluten, collagen), lipids, lignins, and natural rubber; and current polymers derived from naturally sourced monomers and derivatives, such as bio-polyethylene, bio-polypropylene, polytrimethylene terephthalate, polylactic acid, NYLON 11, alkyd resins, succinic acid-based polyesters, and bio-polyethylene terephthalate.

The sheets making up the package 10 may be provided in a variety of colors and designs. Additionally, materials forming the sheets may be pigmented, colored, transparent, semitransparent, or opaque. Such optical characteristics may be modified through the use of additives or masterbatch during the film making process. Any of the materials comprised in the package may be pre-printed with artwork, color, and or indicia 84 before or after forming the package preform using any printing methods, including but not limited to gravure, flexographic, screen, ink jet, laser jet, digital printing and the like. Additionally, the assembled package 10 may be printed after forming using any suitable method, including but not limited to digital, laser jet and ink-jet printing. The printing can be surface printing and/or reverse printing. Any and all surfaces of the package 10 may be printed or left unprinted. Additionally, other decoration techniques may be present on any surface of the sheets such as lenses, holograms, security features, cold foils, hot foils, embossing, metallic inks, transfer printing, varnishes, coatings, and the like. Any one or all of the sheets may include indicia such that a consumer can readily identify the nature of the product, or any given property of the product 100, held in the article reservoir 28 of the package 10, along with the brand name of the producer of the product 100 held in the package 10, the sender of the package 10, or any third-party such as a sponsor of either the producer of the product 100 or the sender of the package 10. The indicia 84 may contain decorative elements and/or may provide information or instructions on use of the product and/or package 10 or other information that may be useful, for example, to the user, shipper, recycler or other party interacting with the package.

Figure 17:
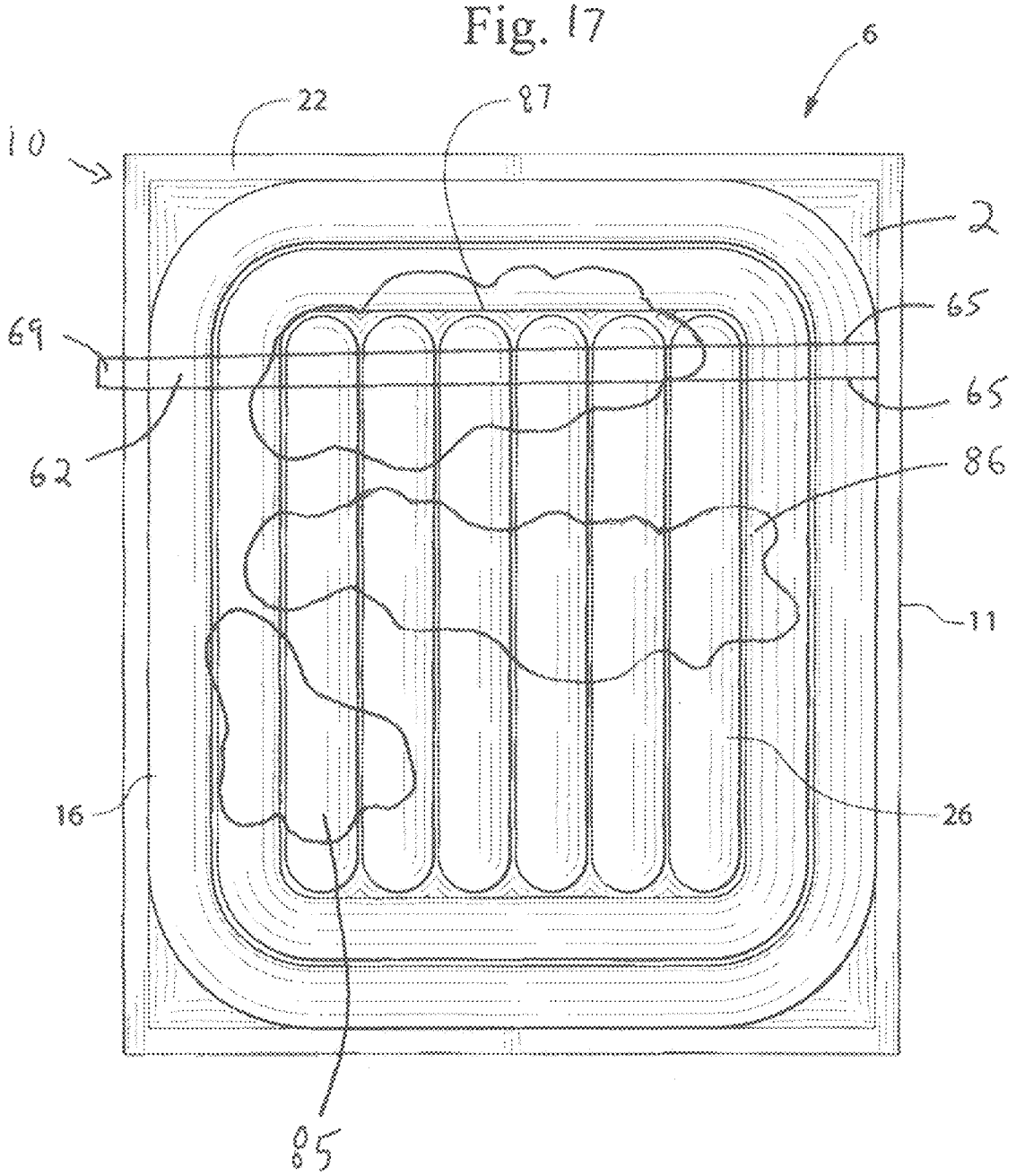
FIG. 17 is a plan view of a flexible package shown in an expanded configuration.
Figure 18:
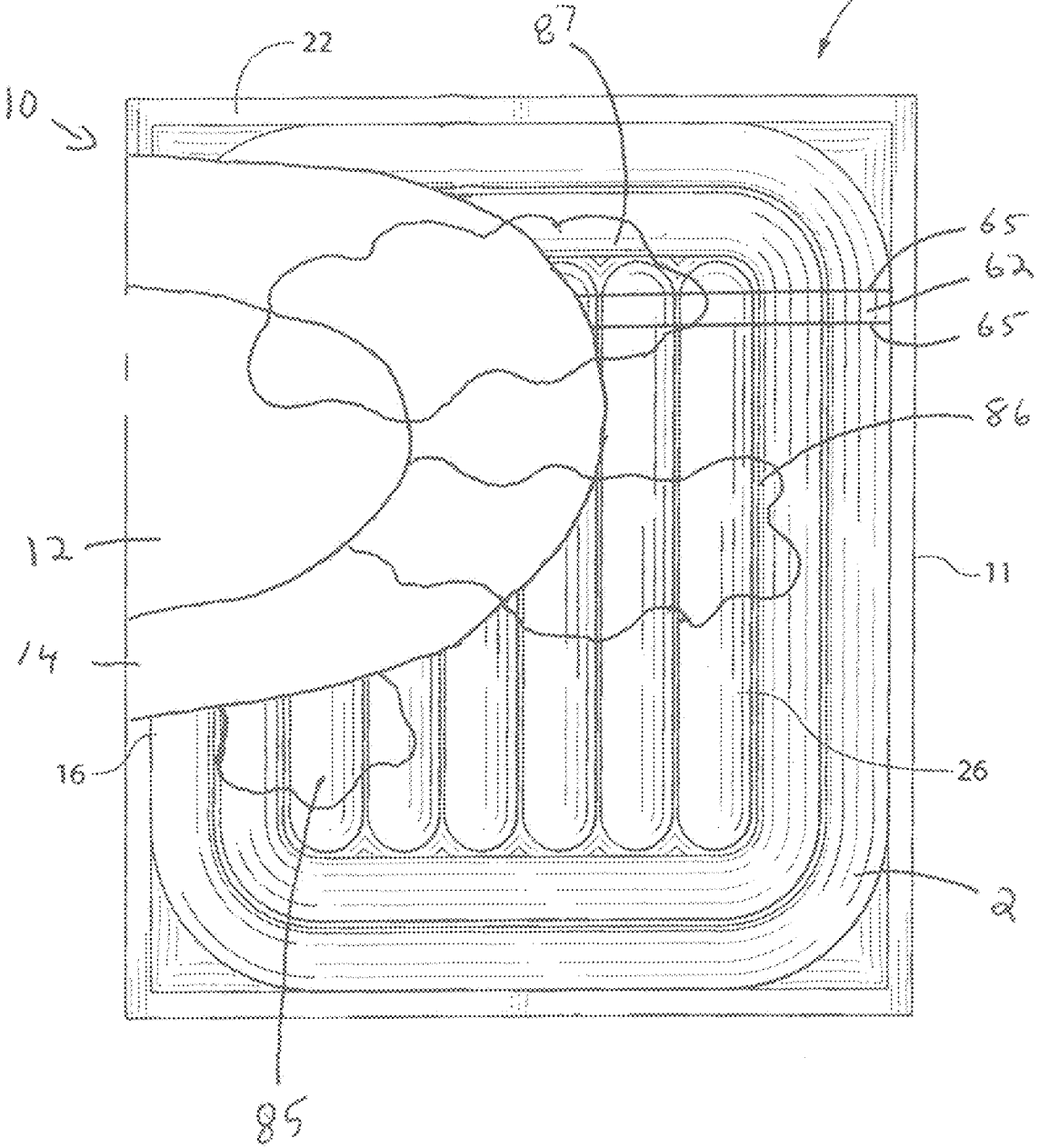
FIG. 18 is a plan view of the flexible package of FIG. 18 with portions cut away to show portions of the different sheets making up the package.

As noted, any indicia 84, printing, decoration, information or the like may be disposed on any portion of any material or materials that make up a portion of the package 10. For example, as shown in FIGS. 17 and 18, indicia 84 may be disposed on one or more of the inner sheet 12, the outer sheet 14, the secondary outer sheet 16. FIG. 17 shows indicia 85, 86 and 87 all of which are visible when viewing, for example, the top panel 2 of the package 10. However, as shown in FIG. 18, the secondary outer sheet indicia 85 is disposed on the secondary outer sheet 16, the outer sheet indicia 86 is disposed on the outer sheet 14 and the inner sheet indicia 87 is disposed on the inner sheet 12. Printing or otherwise providing indicia 84 on different materials, sheets or layers of the package 10 can provide for unique and aesthetically pleasing and/or interesting designs for the package 10. For example, portions of the package 10 may be translucent or transparent allowing indicia printed on different layers to be seen through the translucent or transparent regions. This can provide a three-dimensional look to the package that is not possible with paper, cardboard or other opaque materials. Further, transparent or translucent "windows" can be provided to allow printing or other indicia 84 to be seen through the window. Printing and other indicia 84 can be registered with other printing, indicia 84, portions of the package such at tear strip 62, label areas, and even the product(s) 100 disposed in the package 10 to provide functional or aesthetic features useful or desirable by shippers, manufacturers, customers and others that may interact with the package 10.

Functional inks may be printed on the sheets and functional pigments and dyes can be incorporated into one or more of the materials used to form the package 10. Functional inks, pigments and dyes include those that provide benefits beyond decoration such as, for example and without limitation, printed sensors, printed electronics, printed RFID, light-sensitive dyes, inks and pigments and those that provide texture or other utility such as UV blocking, protection from radiation or other environmental elements, etc.

Additionally, or in the alternative, labels, for example and without limitation, flexible labeling, or heat shrink sleeves may be applied to the sheets making up the packages 10 or the packages 10 themselves before or after expansion to provide the desired visual appearance of the packages 10. Because films can be printed flat and then formed into three dimensional objects, artwork can be designed to conform precisely to the package 10 itself or articles 100 therein. For example, some or all of the printing may be distorted relative to its desired finished appearance, so that the indicia 84 acquire their desired finished appearance upon being formed into three dimensional objects. Such pre-distortion printing may be useful for functional indicia 84 such as logos, diagrams, bar-codes, and other images that require precision in order to perform their intended function.

A variety of primary expansion materials 25 and/or secondary expansion materials 29 may be provided into the primary expansion chambers 24 and secondary expansion chambers 26, respectively. The primary expansion material 25 and/or secondary expansion material may be a gas, a liquid, a solid or a combination thereof. One example of a solid expansion material is a solidifying foam. Such materials can be introduced into the expansion chambers as a fluid that changes to a solid or as a solid. If a foam is used, it may be an expandable foam that increases in volume as the foam solidifies. An example of such foams includes, without limitation, a two-part liquid mixture of isocyanate and a polyol that, when combined under appropriate conditions, solidify to form a solid foam. One advantage of such an expansion material 25 is that it may be possible to use it for the intended purpose without the need to seal the expansion chamber(s), which can simplify the manufacturing and/or expansion chamber filling process. The expansion material may include a perfume, scent, color or have other consumer noticeable attributes that can provide aesthetic and/or functional benefits while enclosed within the expansion chambers or when released therefrom. For example, a scent can be included in the expansion material 25 such that when one or more of the expansion chambers is deflated, the scent is released into the air. Further, an expansion material can be used that provides UV protection, insulation or another desirable function.

The expansion material 25 may be an "expand-on-demand" material that can be expanded at any time by the user. For example, expansion of the expansion chambers 24, 26 may be caused by a phase change of a fluid introduced into the chambers. Examples of the phase change may include injecting a quantity of cooled material, for example and without limitation, liquid nitrogen or dry ice. By sealing the chamber from the external environment and allowing the expansion material to vaporize and/or sublimate when reaching an ambient temperature, pressures between the sheets may cause the expansion chambers to expand. Chemically reactive materials, for example and without limitation, a weak acid, such as citric acid, to a weak base, such as sodium bicarbonate, may be introduced into the chambers and can be activated, as desired, by the user. In such configurations, it may not be necessary to have an opening or port into which the user can introduce the expansion materials.

If chemically reactive materials are used, they can be separated from one another to allow the user to determine when to expand the expansion chambers. For example, they can be separated using a frangible seal, which may be broken to induce a reaction that causes expansion of the expansion chambers. Also, chemically reactive materials may be chosen that are non-reactive with one another at certain environmental conditions, for example at certain temperatures. When expansion of one or more of the expansion chambers is desired, the package 10 may be exposed to the environmental conditions, for example, by increasing the ambient temperature, causing the chemically reactive materials to react with one another to cause the expansion. The chemically reactive materials may be non-reactive with one another unless subject to electromagnetic energy including, for example and without limitation UV light or microwave energy. In such cases, when expansion of one or more of the expansion chambers is desired, the package 10 may be exposed to the electromagnetic energy, causing the chemically reactive materials to react with one another to cause the expansion. Such expand-on-demand expansion materials 25 may be especially desirable for situations where it is useful for the user to be able to expand the expansion chambers at any desired time and/or at a location other than the manufacturing or fulfillment location. For example, a user could purchase a package 10, take it home or to a shipping location, place article(s) 100 in the reservoir 28 and expand the expansion chamber(s).

Although the expansion material may provide any amount of expansion desired, it has been found that a pressure from about ambient pressure to about 25 psig, from about 1 psig to about 20 psig is generally suitable for packages 10 used to ship typical consumer products. Higher or lower pressures may be desired in one or all of the expansion chambers 24, 26 depending on the article(s) 100 being shipped, the method of shipment, the expected environmental conditions, such as the temperature and/or altitude to which the package 10 will be exposed.

The packages 10 of the present invention can be configured to have any desired mechanical, chemical, environmental (e.g. temperature, humidity, light, sound, dust, atmospheric pressure, precipitation, etc.), and other performance characteristics desired. For example, the packages 10 may include materials that resist penetration of humidity, water, light, certain chemicals, and/or gases. An advantage of the package 10 of the present invention is that it can be configured to meet or exceed many of the most common parcel shipping requirements, for example, as set for in industry standards like ISTA performance tests, without the need for multiple different packaging materials or difficult to construct and/or store packages. Bottom out The package 10 may be configured to endure the rigors of shipping through regions of changing ambient air pressure, such as transportation over mountains or shipment via air-cargo. Changes in ambient pressure may include increases in atmospheric pressure and decreases in atmospheric as well as changes in ambient pressure, such as in pressurized cargo holds. Transportation over high altitudes and/or shipment via air-cargo typically include a reduction in ambient air pressure. Such reductions in ambient pressure can result in an expansion chamber 24, 26 that is expanded to a pressure below its burst pressure at or near sea-level to burst during shipment. The expansion chambers 24 and 26 may be inflated sufficiently below their burst-pressure that they do not burst during shipment at reduced ambient pressure and/or may include vents or valves to allow some or all of the expansion material to escape if the expansion chamber is nearing its burst pressure.

In terms of mechanical protection, the packages 10 may be designed and configured to have properties that help protect any articles 100 shipped therein from damage due to mechanical forces, such as dropping, stacking, puncture, squeezing, tearing, pinching, etc. As with other attributes, the package 10 can be specifically designed to meet the needs of the user in terms of mechanical protection by choosing appropriate materials for different parts of the package 10, appropriately designing the shape of the package 10, appropriately expanding the one or more expansion chambers 24, 26, among other things.

One of the most important mechanical damaging forces to protect against during shipping is dropping. Often packages do not provide adequate protection for dropping because they allow the articles being shipped therein to "bottom out" when dropped. Bottoming out occurs when any protective material in the package reaches its limit of protection and thus, the article therein is subjected to the a resistance force of the surface on which it is dropped that is greater than if the package had not reached its limits of protection The packages 10 of the present invention have been found to be particularly good at resisting bottoming out of articles shipped therein, and thus, can effectively prevent breakage and other damage to the articles.

Further, the package 10 may include one or more thermally insulating material. A thermally insulating material is one that would result in an increase of the R-value as measured between the reservoir 28 and the outside of the package. In one example, one or more of the expansion chambers 24, 26 may include a thermally insulating material. Non-limiting examples of thermally insulating materials include foams and gasses with R-values greater than air, such as, for example, noble gases such as argon.

The overall shape of the package 10 may include at least one relatively flat portion or "face". This portion may be useful for applying shipping labels or instructions. Although not required, having a relatively flat portion may be useful in terms of handling the package 10 through conventional shipping systems. For example, when conveying packages at angles, rounded packages have a tendency to tumble, while packages comprising relatively flat portions are less likely to have that disadvantage. The overall shape of the package 10 may be roughly polyhedral. The overall shape of the package may be substantially a rectangular prism. Such shapes can also provide for better stacking, fit into conventional shipping equipment and handling.

Figure 19:
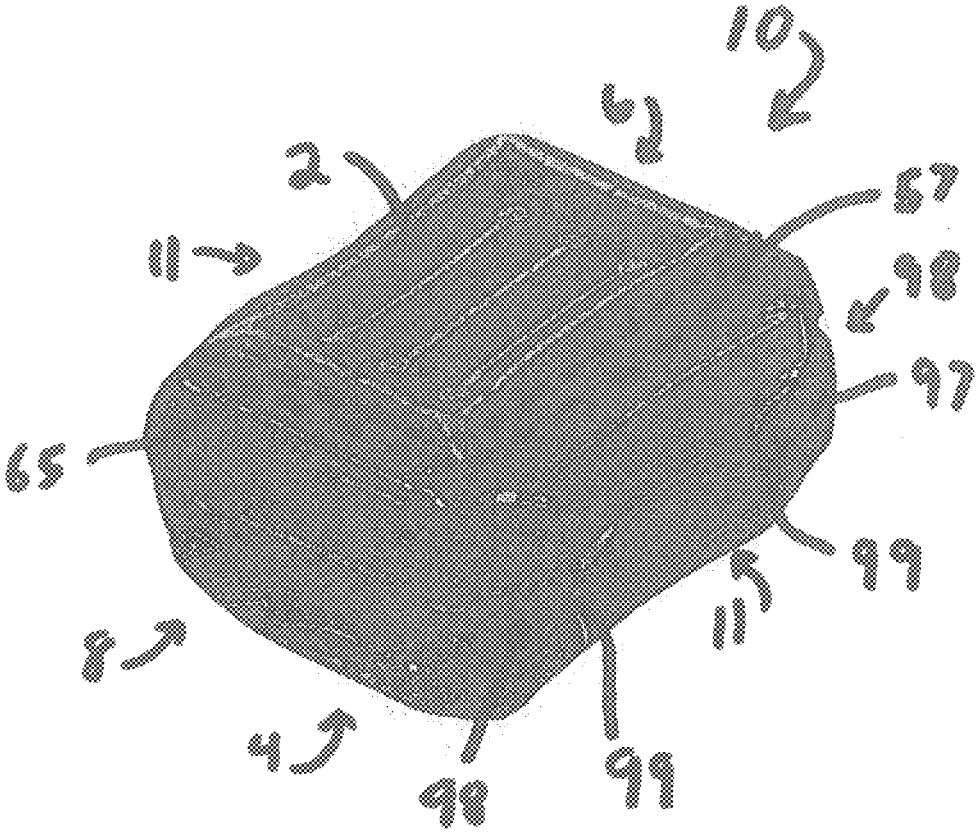
FIG. 19 is a perspective view of a flexible package shown in an expanded configuration.

One way to provide a generally parallelepiped shape is to include one or more gussets in the package 10. Gussets can help reduce the amount of material used in the package 10 and help reduce the overall size of the package 10 is to separate the top panel 2 and the bottom panel 4 from each other such that they are spaced apart when the package 10 is expanded for use. They can also help enable products of different sizes to better fit within the package 10 while maintaining its desired shape. An example of a package 10 including gussets is shown in FIG. 19. Top panel 2 and bottom panel 4 separated by gussets 98. For example, ends 6 and 8 may be folding inwardly and while folded, joined by gusset seams 99 or otherwise held in place relative to the sides 11 that it touches. In the embodiment shown, the ends 6 and 8 each have a gusset panel 97 that is joined to the sides 9 and 11 along the gusset seams 99. This creates the gusset 98 that separates the top panel 2 from the bottom panel 4 and allows the package to have one or more ends that are generally parallel to each other and generally perpendicular to the top panel 2 and bottom panel 4. The sides can be extensions of the top panel 2 and are held in a generally perpendicular orientation to the top panel 2 and bottom panel 4 by the gusset seams 99. Of course, this is merely one exemplary embodiment used to explain how the package 10 may be configured to provide the desired shape. Other configurations are also contemplated that include other types of gussets 98, different folding patterns and/or different orientations of the panels and sides of the package 10 with respect to each other.

Figure 21:
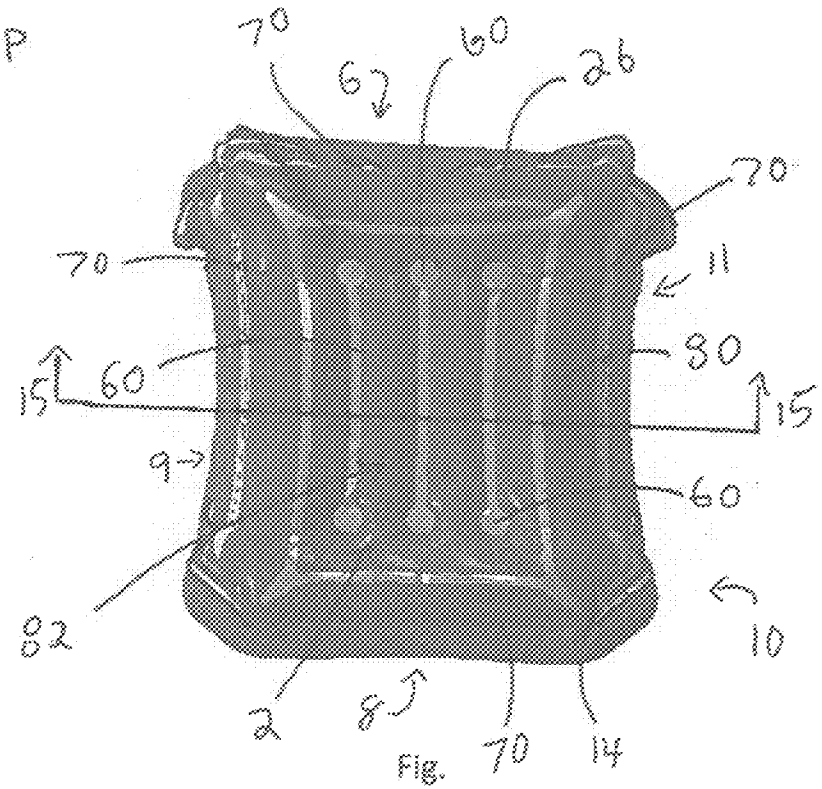
FIG. 21 is a plan view of the top of the flexible package of FIG. 20.
Figure 20:
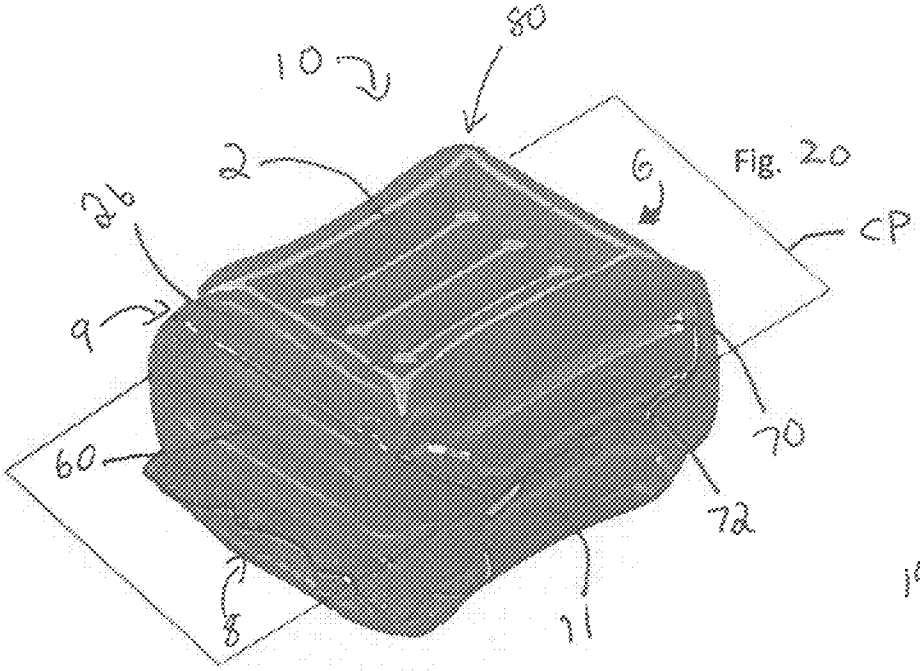
FIG. 20 is an isometric view of a flexible package of the present invention having a parallelepiped shape.
Figure 23:
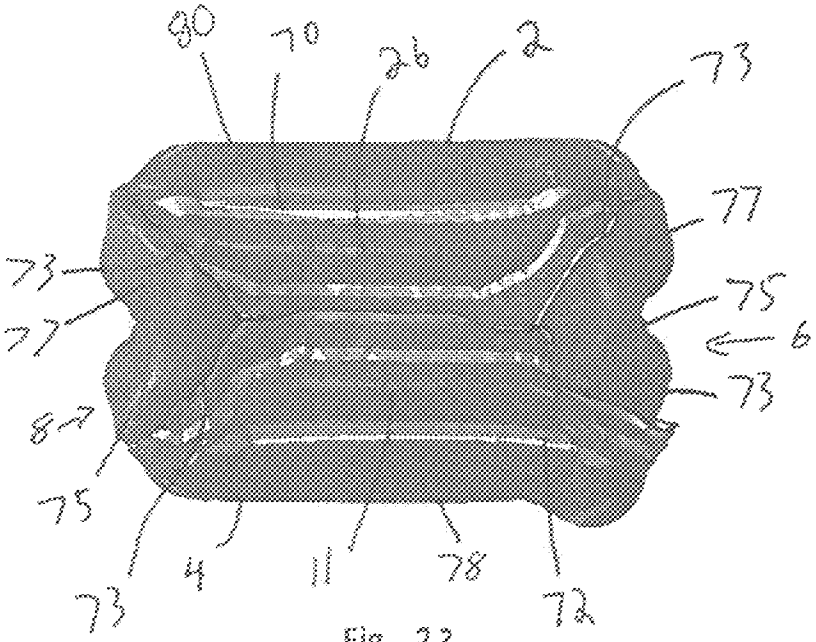
FIG. 23 is a side view of the flexible package of FIG. 20.
Figure 22:
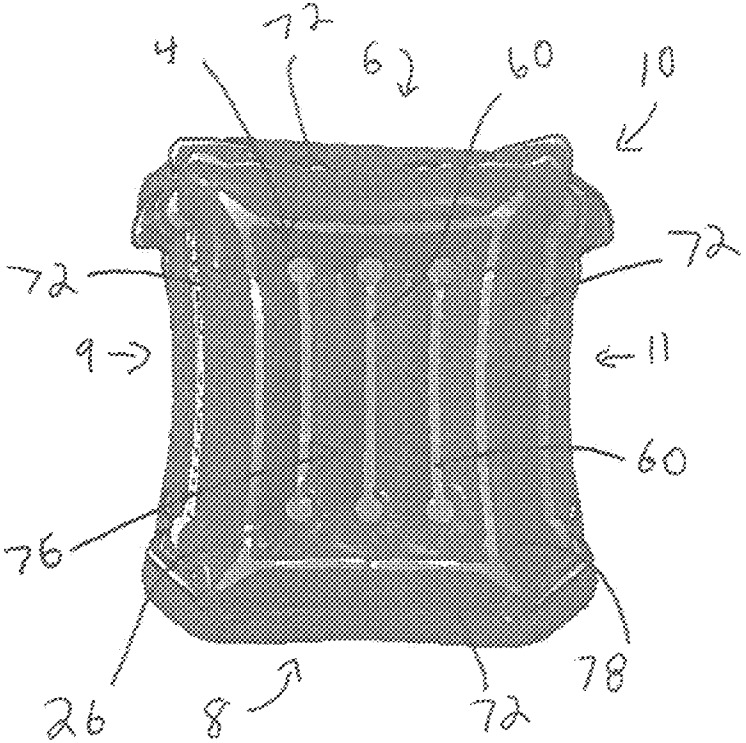
FIG. 22 is a plan view of the bottom of the flexible package of FIG. 20.

FIGS. 20-24 depict an example of a package 10 according to the present invention. FIG. 20 is an isometric view of the package 10, FIG. 21 is a top plan view of the package 10, FIG. 22 is a bottom plan view of package 10, and FIG. 23 is a side view of the package 10. The package has a top panel 2, a bottom panel 4, first side panel 9, second side panel 11 opposed to first side panel 9, first end panel 6, and second end panel 8 opposed to first end panel 6. The first end panel 6 and the second end panel 8 each extend between the top panel 2 and the bottom panel 4 and the first side panel 9 and the second side panel 11. The first side panel 9 and the second side panel 11 each extend between the top panel 2 and the bottom panel 4 and between the first end panel 6 and the second end panel 8. Central plane CP bisects the first end panel 6, the second end panel 8, the first side panel 9 and the second side panel 11.

Figure 24:
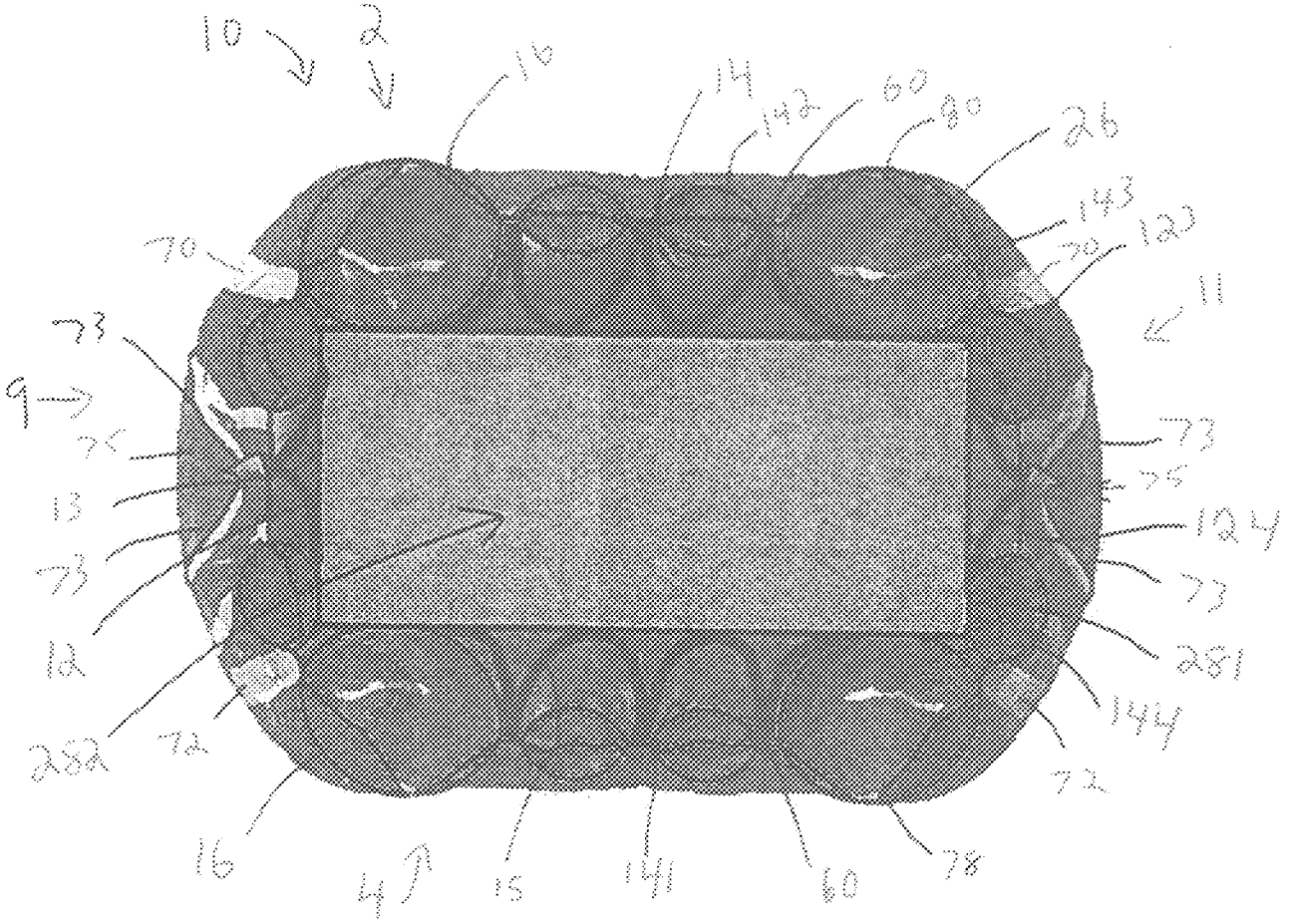
FIG. 24 is a cross-sectional view of the flexible package of FIG. 21 taken through section line 15-15.

As shown in FIG. 24, which is a cross section of the exemplary package 10 shown in FIGS. 20-23, the package 10 also includes an inner sheet 12 having an inner sheet first surface 13, an inner sheet second surface 15, and inner sheet first portion 123, and an inner sheet second portion 124. The package 10 also includes an outer sheet 14 having an outer sheet inner surface 141, an outer sheet outer surface 142, an outer sheet first portion 143, and an outer sheet second portion 144. At least a portion of the outer sheet inner surface 141 of the outer sheet first portion 143 is joined to the inner sheet first surface 13 of the inner sheet first portion 123 to form one or more first primary expansion chambers 241 therebetween. At least a part of the outer sheet inner surface 141 of the outer sheet second portion 144 is joined to the inner sheet first surface 13 of the inner sheet second portion 124 to form one or more second primary expansion chambers 242 therebetween. At least a portion of the inner sheet second surface 15 of the inner sheet first portion 123 is disposed in face-to-face relationship with and joined to a portion of the inner sheet second surface 15 of the inner sheet second portion 124 forming an article reservoir 28 therebetween. The article reservoir 28 has a periphery 281 where the inner sheet first portion 123 and the inner sheet second portion 124 are joined together and a central area 282 within the periphery 281. At least a portion of the inner sheet first surface 13 within the central area 282 is joined to the outer sheet inner surface 141 forming an expansion control tack 60.

The expansion control tack 60 can be formed from or may include any joining means such as adhesive, heat joining, ultrasound, sewing, stitching, melting the sheets together, or any other means or combination thereof. The expansion control tack 60 can be used to help control the shape of the package 10. For example, the expansion control tack 60 can control the size and/or shape of one or more of the first primary expansion chambers 241 when an expansion material 25 is introduced therein. More specifically, the expansion control tack 60 can hold all or a portion of the outer sheet 14 closer to the inner sheet 12 than it would otherwise be once any expansion chambers are expanded. The tack 60 can be any shape, length, width or thickness and can be continuous or intermittent. The tack 60 can be permanent such that it is not able to be released or may be releasable. The tack 60 may be formed before or after the package 10 is expanded and may be disposed anywhere on the package 10 and between any two or more sheets forming any part of the package 10. In the example shown, the package 10 includes three expansion control tacks 60 disposed in the top panel central region 82, three expansion control tacks 60 in the bottom panel central region 76 and one expansion control tack 60 in each of the side panels 9 and 11 and the end panels 6 and 8.

As shown in FIGS. 20-24, a secondary outer sheet 16 may be at least partially joined to the outer sheet outer surface 142 to form a plurality of secondary expansion chambers 26. As noted above, any number of secondary expansion chambers 26 is possible and the location, shape and size of the secondary expansion chambers 26 can be chosen based on the desired shape and other characteristics of the package 10. At least one secondary expansion chamber 26 may be disposed at least partially in the top panel 80 adjacent a first juncture 170 between the top panel 2 and the first end panel 6, the second end panel 8, the first side panel 9 and the second side panel 11. The at least one secondary expansion chamber 26 disposed adjacent the first juncture 170 may provide a top surface 80 on which other packages or articles may be set or stacked, or upon which the package 10 may be set or stacked. The top surface 80 may surround all or a portion of the top panel central region 82. Further, the article 10 may include at least one secondary expansion chamber 26 disposed at least partially in the bottom panel 4 and adjacent a second juncture 72 between the bottom panel 4 and the first end panel 6, the second end panel 8, the first side panel 9 and the second side panel 11. The at least one secondary expansion chamber 26 disposed adjacent the second juncture 72 may provide a base 78 on which the package 10 may be set or stacked. The base 78 may surround all or a portion of the bottom panel central region 76.

In embodiments including a secondary outer sheet 16, any portion of the secondary outer sheet 16 may be joined to any other sheet forming a part of the package 10. For example, the secondary outer sheet 16 may be joined to the outer sheet 14 and/or the inner sheet 12 along all or a portion of the exterior seams 22. Further, the secondary outer sheet 16 may be joined to the outer sheet 14 with expansion control tacks 60. In such cases, if the package also includes expansion control tacks 60 between the outer sheet 14 and the inner sheet 12, the expansion control tacks 60 between the secondary outer sheet 16 and the outer sheet 14 may be the same as, form part of, be different from, and/or be located in the same or different locations from the expansion control tack(s) 60 between the inner sheet 12 and the outer sheet 14. In FIGS. 20-24, the expansion control tack 60 joins the inner sheet 12 and the outer sheet 14 as well as the outer sheet 14 and the secondary outer sheet 16, however, as mentioned, this need not be the case. Different tacks 60 can be used for some or all of the expansion control tacks 60 between the different sheets.

Together, the expansion control tacks 60 can be used to help control the shape of the package 10 such that it expands to and maintains the desired shape, such as, for example, a generally parallelepiped shape. As noted above, other means may also be used to help provide the package 10 with the desired shape. For example, air may be removed from the article reservoir 28 to create a full or partial vacuum to help hold portions of the package 10 in the desired configuration. Yet other means, including static, friction, magnets, stitching, tape, glue, bonds as well as other known means for holding materials in place may be used alone or in combination with any other suitable tacking means. Of course, other shapes can be obtained by changing the shapes and sizes of the sheets making up the package, the location, size and number of expansion chambers and the shape, size and number of expansion control tacks 60.

In addition, or alternatively, the shape of the package 10 may be influenced by the amount of expansion material 25 that is placed in the expansion chambers. For example, one or more expansion chambers may be expanded to an internal pressure that is greater than or less than one or more other expansion chambers. In one exemplary embodiment, one or more secondary expansion chamber 26 may be expanded such that it has an internal pressure that is less than the internal pressure of one or more of primary expansion chambers 24. For example, one or more secondary expansion chambers 26 disposed adjacent the central area of the reservoir 281 may be expanded to an internal pressure that is less than the internal pressure of the one or more primary expansion chambers 24. This can help shape the package 10 such that one or more of the to, bottom, side or end panels presents a generally flat surface rather than a surface that is curved or bulging. Also, it is contemplated that one or more of the expansion chambers may be unexpanded during use. That is, one or more of the expansion chambers may not include an expansion material 25 or the expansion material 25 may not be caused to expand the expansion chamber during use. For example, one or more secondary expansion chambers 26 disposed adjacent the central area of the reservoir 282 may remain unexpanded. Again, this can help shape the package 10, as desired. Other than not providing an expansion material 25 in the one or more expansion chambers that are to remain unexpanded, an activatable expansion material 25 can be used that is not activated and/or holes may be provided in the one or more expansion chambers such that an expansion material 25 introduced merely escapes the expansion chamber through the holes.

One feature that can help reduce the amount of material used in the package 10 and help reduce the overall size of the package 10 is to separate the top panel 2 and the bottom panel 4 from each other such that they are spaced apart when the package 10 is expanded for use. As described above, one way to do that is to provide sides 9 and 11 and ends 6 and 8 between the top panel 2 and bottom panel 4. End panels 6 and 8 may be provided by folding the sheets of material making up the package 10 in a configuration to form gussets 75, such as those shown in FIG. 23. For example, the material forming the ends 6 and 8 is folded inwardly and while folded, joined by gusset seams 73 or otherwise held in place relative to the side panel 9 or 11 that it touches. In the embodiment shown, the ends 6 and 8 each have a gusset panel 77 that is joined to the sides 9 and 11 along the gusset seams 73. This creates the gusset 75 that separates the top panel 2 from the bottom panel 4 and allows the package to have one or more ends 6 and/or 8 that are generally parallel to each other and generally perpendicular to the top panel 2 and bottom panel 4. The sides 9 and 11 can be extensions of the top panel 2 and side panel 4 and are held in a generally perpendicular orientation to the top panel 2 and bottom panel 4 by the gusset seams 73. Of course, this is merely one exemplary embodiment used to explain how the package 10 may be configured to provide the desired shape. Other configurations are also contemplated that include other types of gussets 75, different folding patterns and/or different orientations of the panels and sides of the package 10 with respect to each other.

As noted above, one often desirable feature of a package is for it to have a stable base onto which it can be placed. One way to ensure that a stable base 78 is provided, for example on the bottom panel 4, is to ensure that the base 78 is that part of the package 10 that extends a greater distance from the central plane CP than any other portion of the bottom panel 4. Specifically, as shown for example, in FIG. 25, it may be desirable that the base 78 extends from the central plane CP a distance, base distance BD, and preferably the maximum base distance BD, that is greater than the distance, central region distance CRD, and preferably the maximum central region distance RCRD, that the bottom panel central region 76 extends from the central plane CP. The same can be done with the top surface 80 or any other panel of the package 10. For example, it may be desirable to ensure that the top surface 80 extends a greater distance from the central plane CP than any other portion of the top panel 2. Specifically, it may be desirable that the top surface 80 extends from the central plane CP a distance, top surface distance TSD, and preferably a maximum top surface distance TSD that is greater than the distance, top panel central region distance TCRD, and preferably the maximum top panel central region distance TRCD that the top panel central region 82 extends from the central plane CP.

Figure 25:
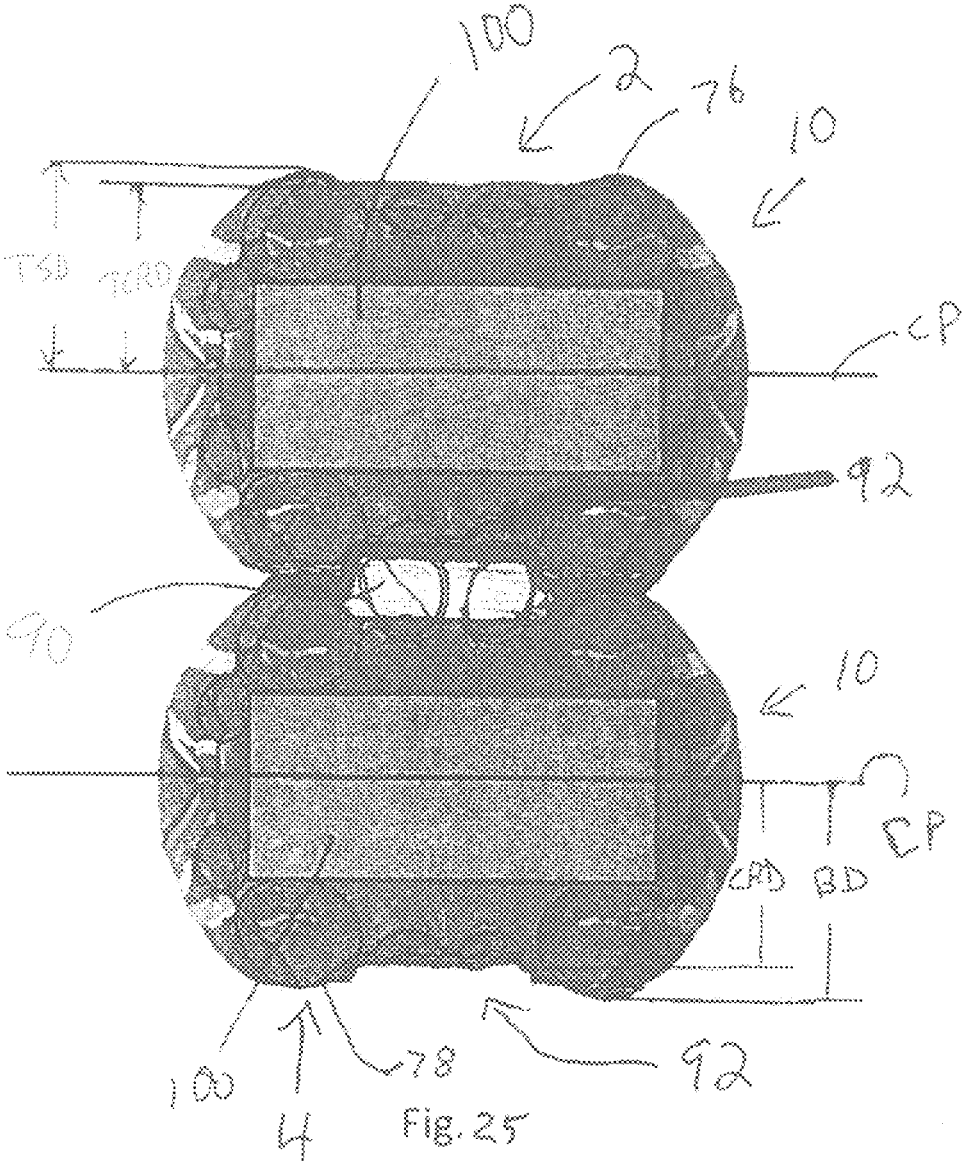
FIG. 25 is a cross-sectional view of two stacked packages in accordance with the present invention.

Another feature that may be desirable for certain packages is a structure that provides for nesting of one or more surfaces of the package 10 with other surfaces and/or other packages 10. For example, it may be desirable the that top panel 2 of one package is configured to nest with the bottom panel 4 of another package or packages. By nesting, it is meant that a structural feature of one article (e.g. package 10) is able to fit within or otherwise interact with a structural feature of another article (e.g. another package 10 or a surface) in a predetermined way so as to improve how the two articles fit together or coexist in a particular space. Nesting can allow for reduced space needed for shipping or storing multiple packages, can help keep packages from shifting, moving or falling, and can help ensure packages are oriented as desired with other packages or surfaces, etc. Nesting can be realized by shaping one or more of the surfaces or panels of the package 10 to deliberately interact with another surface, article or package. For example, the top panel 2 of the package 10 may be shaped to nest with the bottom panel 4 of another package 10. Alternatively, or in addition, other sides, ends or panels of the package may be configured for nesting. One example of a package 10 configured for nesting is shown in FIG. 25. As shown, the top panel 2 includes a protruding expansion chamber 90 that extends beyond the top surface 80 of the top panel 2. In the embodiment shown, the protruding expansion chamber 90 is generally in the shape of a rectangular parallelepiped extending outwardly from the top surface 80 of the package 10. The same package 10 has an inwardly extending depression 92 disposed on the bottom panel 4 that is sized and shaped such that the protruding expansion chamber 90 can fit at least partially within the depression 92. Of course, any side, end or panel can have one or more protrusions 90 or depressions and the protrusions 90 and depressions can have any desired shape, height or depth.

It may be desirable for the package 10 to have one or more outwardly-facing surfaces that are relatively planar. A relatively planar outwardly-facing surface can provide the benefits of allowing for easy application of a label and/or printing, and can also make the package 10 more stable during shipment and storage. One difficulty with providing one or more relatively planar surfaces in packages of the invention described herein is that the expansion chambers often create curved and/or irregular surfaces when they are expanded. As such, it would be desirable to have the advantages of the inventive package described herein, but also the added benefit of one or more relatively planar surfaces. Several ways to provide such desired relatively planar surfaces are contemplated. For example, an external wrap 300, as shown in FIG. 26, may be provided that surrounds some or all of the package 10 and provides one or more outwardly facing relatively planar surfaces 310.

The external wrap 300 can be made of any desirable material, including plastic films, foils, woven materials, nonwoven materials, composite materials, paper, and/or any other flexible material. Of course, non-flexible materials may be used, but such materials tend to be less preferred where the benefits of a flexible package are desired. Examples of materials that are especially useful are shrink films, stretch films and other polymeric films. Such materials may, for example, be formed into sleeves that can be placed around all or a portion of the package 10 or can be discrete sheets and/or continuous materials that are wrapped about the package 10 and cut to the desired size. In some embodiments, the external wrap 300 extends about the entire circumference of the package 10 and in other embodiments, the external wrap 300 may be a discrete sheet of material that extends only across a portion of the circumference of the package 10. For example, the external wrap 300 may extend across one or more sides of the package 10 or may extend across only a single side or portion of a single side of the package 10. Multiple external wraps 300 are also contemplated. For example, different materials or the same material may be used in multiple layers or in different locations on the package 10.

Figure 28:
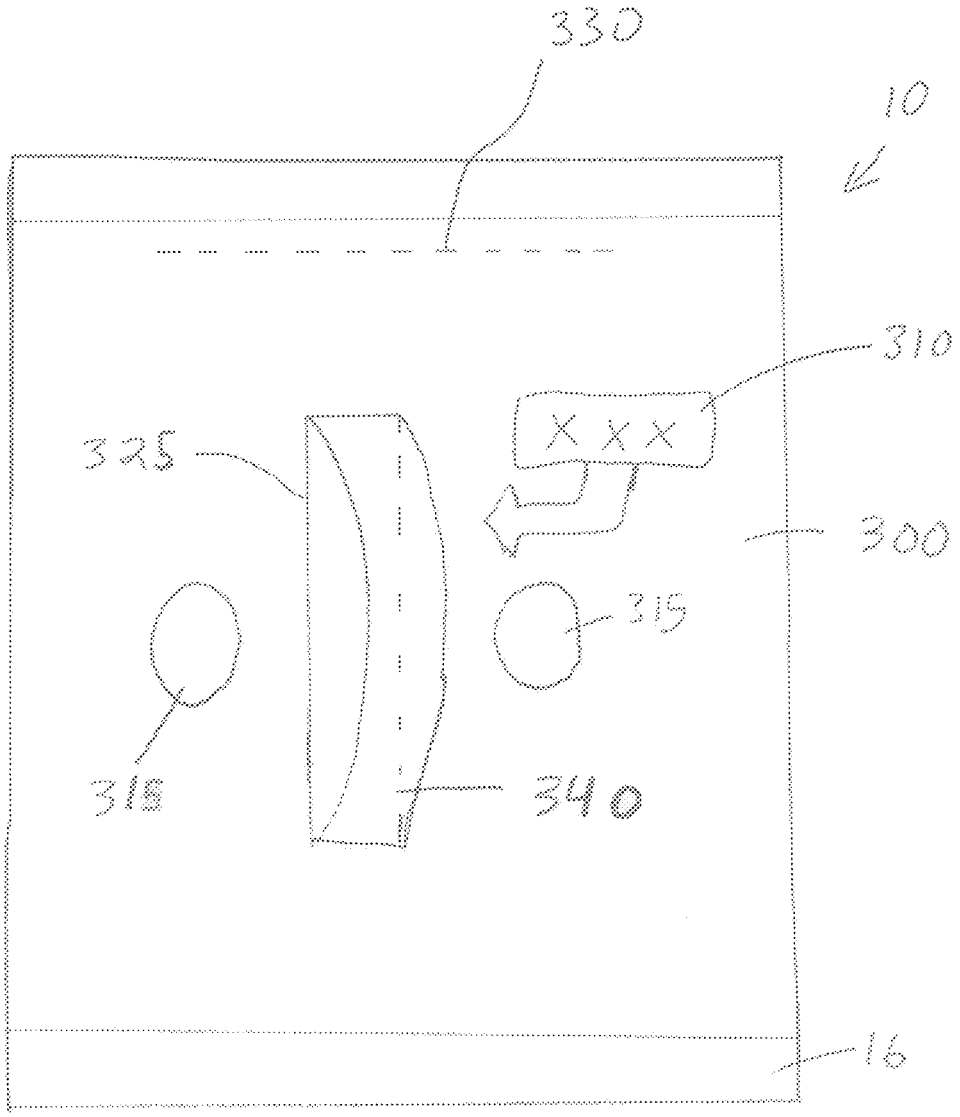
FIG. 28 is a simplified plan view of a package of the present invention.

The external wrap 300, or any portion thereof, may be printed, mechanically or chemically modified or otherwise provided with one or more indicia, including but not limited to letters, numbers, characters, graphics, etc. The indicia may be 2-dimensional or three dimensional. Additionally or alternatively, the external wrap 300 may be provided with a scent, texture or other functional characteristic. Further, the external wrap 300 may be provided with a coating or have imbedded therein a material that acts to provide some other benefit, such as, for example, UV protection, scuff, tear or puncture resistance, insulative properties, coefficient of friction modification, or any other beneficial property that might be desired by the user. The external wrap 300 may also provide dimensional stability and/or uniformity to the package 10, which can be advantageous for shipping, handling, stacking and storage. For example, the external wrap 300 may provide or may be used to join one or more handles, a grip region, a hanger or other functional feature. FIG. 28 is a simplified figure showing an example of a package 10 of the present invention wherein the external wrap 300 has holes 315, slits 325, perforations 330 and external wrap handle 340. Of course, any combination of these and other functional features may be included and formed from or joined to the external wrap 300. Such functional features may also be aligned with decorative or instructional indicia, such as external wrap indicia 310, to help the user use the package 10 and or to provide an aesthetically desired configuration.

The benefits of employing an external wrap 300 are numerous, some of which are noted above. However, some of the most beneficial aspects relate to aesthetics and ease of printing or decorating. As noted, use of an external wrap 300 can provide for a relatively planar surface onto which a label may be placed and/or onto which ink or another material may be printed (e.g. the external wrap 300 may be the shipping or other label). Further, use of an external wrap 300 allows for printing and/or otherwise treating the material making up the external wrap 300 at a time, process and/or location different from manufacture, filling, expanding and/or closing of the package 10. Thus, it allows for late stage customization of packages. It can also provide for printing and handling of the outer wrap 300 at speeds that are higher than they might otherwise be if the printing of the external wrap 300 had to be done when the wrap is integral with, joined to or disposed about the package 10. It also allows for more simple printing of the package 10 after it is expanded as the external wrap 300 can provide a planar surface even after expansion. Further still, the external wrap 300 can provide a "billboard" on the package to allow for improved communication to the user and/or end consumer. Even further, this allows for the package 10 to be produced more generically in terms of printing and decoration, which can save cost, and then provided with the desired information, aesthetics and/or labelling at a later stage allowing for more customization and more efficient handling. Also, providing a relatively planar surface allows use of existing labeling and handling equipment and can also help with storage and/or shipping as well as provide what looks like a more finished or refined package.

Any portion or surface of the external wrap may be printed or otherwise include external wrap indicia 320 (e.g. shown in FIG. 27) and the external wrap 300 or portions thereof may be opaque, translucent or transparent. Further, any one or more of the external wrap indicia 310 and/or any opaque, translucent or transparent portion of the external wrap 300 may be aligned with any indicia 84, transparent, translucent or opaque portion of any other sheet of the package 10.

The external wrap 300 can be a separate piece or pieces of material that can be affixed to any portion of the package 10 or may be unjoined thereto. It can be wrapped around a portion or the entirety of the package 10. It can be stretched and/or shrunk to snugly fit about the package 10. For example, a stretch wrap or shrinkable material such as a shrink wrap or shrink sleeve may be used and wrapped around the package 10 after an article 100 is placed therein and one or more of the expansion chambers is expanded. Alternatively, a stretch wrap, shrinkable material or a non-stretchable material may be wrapped about or affixed to the package 10 before an article is placed therein and/or before one or more of the expansion chambers is expanded. Further still, a shrink wrap material can be used that can be disposed about a portion of the package and then shrunk to provide a taught, relatively flat surface. The external wrap 300 can be provided with the package 10 as an integral part thereof or can be a separate piece or pieces that can be used or not based on the desires of the particular user.

There are several advantages of providing the external wrap 300 as a separate material than that which makes the entirety or a portion of the rest of the package 10. One example is that the external wrap 300 can be made of a material with different properties than the rest of the package 10 and this can make the overall package less expensive. For example, the external wrap 300 could be made of a material that is stronger, thicker, more puncture resistant, etc. than the rest of the package 10. Since the external wrap 300 material can be independent of the other materials that make up the package, the user can choose a more expensive material for the external wrap 300 and a less costly material for the rest of the package 10 than would have otherwise been useful for the particular situation if the external wrap 300 was not used. Another example is that either or both the external wrap 300 or the material making up the rest of the package 10 can be recyclable and/or reusable, but possible in different recycling streams or reusable for different purposes. Thus, it may be desirable to have the external wrap 300 made of a different material than some or all of the rest of the package 10.

Figure 12:
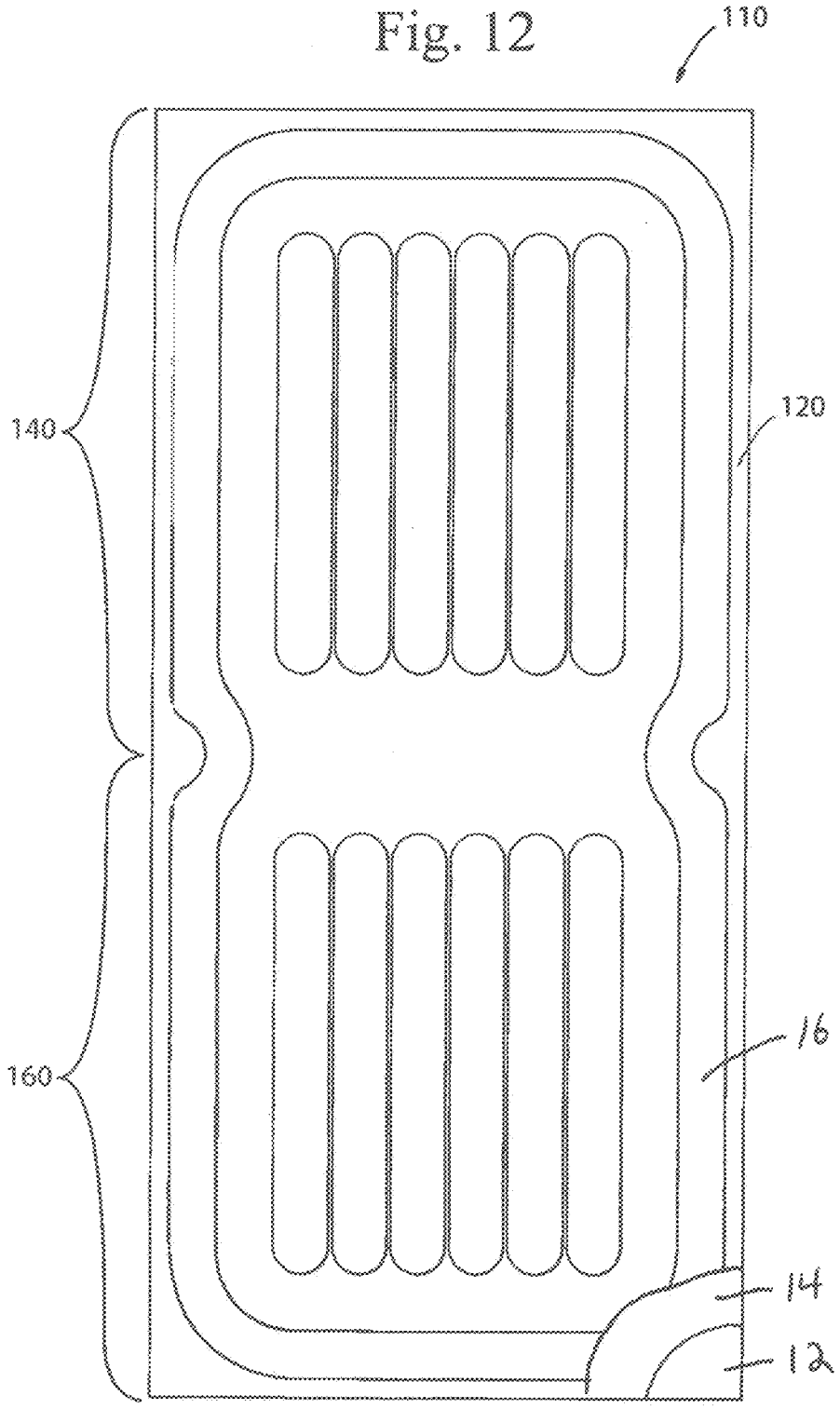
FIG. 12 is a plan view of a preform of a package of the present invention before it is assembled into the final package.

Referring now back to FIG. 12, a preform 110 of an example of the flexible package 10 of the present invention is depicted before assembly where the inner sheet 12, the outer sheet 14 and the secondary outer sheet 16 are disposed on top each other to form a three-layer assembly 120. As shown, first sheet portion 140 and second sheet portion 160 are not yet folded upon each other to form the unexpanded package 10. During assembly, the preform 110 is folded such that first sheet portion 140 and second sheet portion 160 are disposed such that the inner sheet 12 of the first sheet portion is facing and disposed adjacent to the inner sheet 12 of the second sheet portion. After being folded, the first sheet portion 140 and the second sheet portion 160 are joined together at exterior seams 22, as shown in FIG. 6. The exterior seam 22 joins the first and second portions 140 and 160 to one another, thereby forming the package 10 having article reservoir 28. The article reservoir 28 is therefore enclosed by the exterior seam 22 between the inner sheet 12 of the first and second sheet portions 140 and 160.

Packages 10 according to the present disclosure may be manufactured according to a variety of methods. For example, the package 10 may be assembled according to the method described below. A first film (the inner sheet 12) and a second film (the outer sheet 14) are placed onto one another. A plurality of primary expansion chamber seams 20 are formed by heat sealing. The primary expansion chamber seams 20 may be formed by a heat or other sealing operation to define the expansion chamber(s) 24. As noted herein, a secondary outer sheet 16 may also be included in the package 10. In such embodiments, the secondary outer sheet 16 may be first joined to the outer sheet 14 and then the combined secondary outer sheet 16 and outer sheet 14 can be joined to the inner sheet 12. Alternatively, the inner sheet 12 and the outer sheet 14 may be joined together first and then joined to the secondary outer sheet 16. Joining the secondary outer sheet 16 to the outer sheet 14 can form one or more secondary expansion chambers 26.

The sheets 12, 14 and/or 16 may be joined by any suitable means, including using heat, glue or any of the other means and methods described herein and other known and later developed methods for joining flexible materials. A heat seal die may be used to form the seam 20. If so, the die is heated to the desired temperature and pressed against the first and second films 12 and 14 to create the seams 20. The inner and outer sheets 12 and 14 may be positioned relative to the heat seal die a second time to create additional primary expansion chambers 24. If the package 10 includes three or more sheets creating any portion thereof, a heated die can be used to form secondary expansion chambers 26.

Prior to heat sealing, a one-way film valve may be placed between the inner sheet 12 and the outer sheet 14 the film valve spans across a location where the sheets 12, 14 and/or 16 will have a seam 20. One-way film valves are conventionally known and are described, for example, at U.S. Pat. Pub. No. 2006/0096068. The one-way film valve may include an ink or polymer material on at least a part of the film valve that enables the film valve to be sealed into the seams created by the heat seal die, but without sealing the film valve shut.

Before or after the expansion chamber(s) 24 are formed, the ends and/or sides of the sheets may be joined to form the article reservoir 28 and the general shape of the package 10. Air, or another expansion material, may be introduced through the one-way film valve(s) to expand the expansion chamber(s) 24. Air may be introduced at any suitable pressure. For example, air may be introduced at a pressure from about 1 psig to about 20 psig to expand the chamber(s) 24 without risk of rupture of the first and second films by overpressure. Further, as noted, other expansion materials may be used and the primary expansion chambers 24 and secondary expansion chambers 26, if any, may be expanded to different pressures.

A plurality of packages 10 may be formed from larger continuous sheets of material. The packages 10 may be formed simultaneously or in series.

The packages 10 can use any and all materials, structures, and/or features for the packages 10, as well as any and all methods of making and/or using such packages 10, disclosed in the following US patents and applications: (1) U.S. Pat. No. 9,815,258 filed May 7, 2012, entitled "Film Based Packages"; (2) U.S. Publication No. 2013/0292395 A1 filed May 7, 2012, entitled "Film Based Packages"; (3) U.S. Publication No. 2013/0292287 A1 filed Jul. 26, 2012, entitled "Film Based Package Having a Decoration Panel"; (4) U.S. Patent application 61/727,961 filed Nov. 19, 2012, entitled "Packages Made from Flexible Material"; (5) U.S. Pat. No. 10,040,581 filed Aug. 6, 2012, entitled "Methods of Making Film Based Packages"; (6) U.S. Publication No. 2013/0292413 A1 filed Mar. 13, 2013, entitled "Flexible Packages with Multiple Product Volumes"; (7) U.S. Pat. No. 9,469,088 filed Mar. 15, 2013, entitled "Flexible Materials for Flexible Containers" 61/789,135; (8) U.S. Patent Application 62/701,273 filed Jul. 20, 2018 entitled "Adsorbent Matrix as Propellant in Aerosol Package"; (9) U.S. Patent Application 62/783,535 filed Dec. 21, 2018 entitled "Shaped Flexible Shipping Package and Method of Making"; (10) U.S. Patent Application 62/810,987 filed Feb. 27, 2019 entitled "Flexible Shipping Package"; (11) U.S. Patent Application 62/838,955 filed Apr. 26, 2019 entitled "Flexible Shipping Package and Method of Making"; (12) U.S. Patent Application 62/851,224 filed May 22, 2019 entitled "Flexible Package and Method of Manufacture"; (13) U.S. Patent Application 62/851,230 filed May 22, 2019 entitled "Flexible Package and Method of Manufacture"; (14) U.S. Patent Application 62/864,549 filed Jun. 21, 2019 entitled "Flexible Package and Method of Manufacture"; and (15) U.S. Patent Application 62/864,555 filed Jun. 21, 2019 entitled "Flexible Package"; each of which is hereby incorporated by reference.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or patent publication, is hereby incorporated herein by reference in its entirety unless expressly excluded or otherwise limited. The citation of any document is not an admission that it is prior art with respect to any document disclosed or claimed herein or that it alone, or in any combination with any other reference or references, teaches, suggests or discloses any such embodiment. Further, to the extent that any meaning or definition of a term in this document conflicts with any meaning or definition of the same term in a document incorporated by reference, the meaning or definition assigned to that term in this document shall govern.

While certain embodiments, variations and features have been illustrated and described herein, it should be understood that various other changes and modifications may be made without departing from the spirit and scope of the claimed subject matter. Although various aspects of the claimed subject matter have been described herein with respect to certain examples and embodiments, such aspects need not be utilized in every embodiment and/or in any particular combination. It is therefore intended that the appended claims cover all such changes and modifications that are within the scope of the claimed subject matter.

What is claimed is:

1. A package for one or more articles, comprising:

a. a flexible inner sheet having a first surface and a second surface, an inner sheet first portion and an inner sheet second portion;

b. a flexible outer sheet having an outer sheet first portion, and an outer sheet second portion, at least a portion of the outer sheet first portion being joined to the first surface of the inner sheet first portion to form one or more first primary expansion chambers therebetween, and at least a part of the outer sheet second portion being joined to the first surface of the inner sheet second portion to form one or more second primary expansion chambers therebetween; at least a portion of the second surface of the inner sheet first portion disposed in face-to-face relationship with and joined to a portion of the second surface of the second portion of the inner sheet forming an article reservoir therebetween; wherein the article reservoir has a periphery where the inner sheet first portion and the inner sheet second portion are joined together;

c. a closeable opening into which the one or more articles may be inserted; and d. a film external wrap surrounding at least a portion of the package and providing at least one relatively planar outwardly-facing surface for the package wherein the outer sheet has an inner surface facing the inner sheet and an outer surface opposite of the inner surface and wherein the package further includes a secondary outer sheet disposed adjacent the outer surface of the outer sheet and is at least partially joined thereto, the secondary outer sheet and the outer sheet forming one or more secondary expansion chambers and the one or more secondary expansion chambers provides structural rigidity and/or shape to the shipping package when in an expanded configuration, where at least one of the primary expansion chambers is in fluid communication with at least one of the one or more secondary expansion chambers, the one or more primary expansion chambers and the one or more secondary expansion chambers positioned to provide at least one relatively flat portion on an outer surface of the package.

2. The package of claim 1 further including an article retrieval feature that allows a user to open the package and retrieve the one or more articles from the article reservoir.

3. The package of claim 1 having two or more primary expansion chambers, wherein at least some of the primary expansion chambers and/or secondary expansion chambers are independent from each other or are in fluid communication with each other.

4. The package of claim 1 wherein the external wrap provides structural rigidity, puncture resistance and/or shape to the package when in an expanded configuration.

5. The package of claim 2 wherein the article retrieval feature, when activated, both opens the package and deflates one or more of the one or more primary expansion chambers and/or one or more of the one or more secondary expansion chambers.

6. The package of claim 1 wherein the external wrap is un-joined to the package or is joined to the package at one or more locations.

7. The package of claim 1 wherein the external wrap is a different material than the inner sheet, the outer sheet or both.

8. The package of claim 1 wherein the external wrap is disposed about the entirety of the package or only a portion of the package.

9. The package of claim 1 wherein the external wrap includes or provides a handle.

10. The package of claim 1 wherein the external wrap includes one or more indicia disposed thereon.

11. The package of claim 1 wherein at least one of the inner sheet, the outer sheet and the secondary outer sheet include a first indicia and wherein the external wrap includes at least a second indicia and wherein at least a portion of the second indicia is disposed in a predetermined location with respect to the first indicia.

12. The package of claim 1 wherein a portion of the external wrap is opaque, transparent or translucent.

13. The package of claim 11 wherein at least one of the inner sheet, the outer sheet and the secondary outer sheet include a first indicia and wherein the portion of the external wrap that is opaque, transparent or translucent is disposed in a predetermined location with respect to the first indicia.

14. The package of claim 1 wherein at least one of the inner sheet, the outer sheet and the secondary outer sheet include an opaque, translucent or transparent portion, wherein the external wrap includes an indicia thereon and wherein the indicia is disposed in a predetermined location with respect to the opaque, transparent or translucent portion of the inner sheet, outer sheet and/or secondary outer sheet.

15. The package of claim 1 wherein the external wrap is or includes a label.

16. The package of claim 1 wherein the package consists of or consists essentially of a flexible material.

17. The package of claim 1, wherein the flexible external wrap is a film.

18. The package of claim 2, wherein the article retrieval feature is provided on the surface of the article reservoir.

* * * * *